US012680771B1

(12) United States Patent
Herring

(10) Patent No.: US 12,680,771 B1
(45) Date of Patent: Jul. 14, 2026

(54) CALIBER AND FEED-SIDE CONVERTIBLE FIREARM

(71) Applicant: Ares Defense Systems, Inc., Melbourne, FL (US)

(72) Inventor: Geoffrey A. Herring, Melbourne, FL (US)

(73) Assignee: Ares Defense Systems, Inc., Melbourne, FL (US)

( * ) Notice: Subject to any disclaimer, the term of this patent is extended or adjusted under 35 U.S.C. 154(b) by 0 days.

(21) Appl. No.: 19/253,460

(22) Filed: Jun. 27, 2025

(51) Int. Cl.
*F41A 9/29* (2006.01)
*F41A 9/34* (2006.01)
*F41A 9/37* (2006.01)

(52) U.S. Cl.
CPC ..... *F41A 9/34* (2013.01); *F41A 9/29* (2013.01); *F41A 9/37* (2013.01)

(58) Field of Classification Search
CPC ..... F41A 9/29; F41A 9/38
See application file for complete search history.

(56) References Cited

U.S. PATENT DOCUMENTS

| | | | |
|---|---|---|---|
| 1,293,021 A | 2/1919 | Browning | |
| 1,628,226 A | 5/1927 | Browning | |
| 2,845,001 A | 7/1958 | Hillberg | |
| 11,268,774 B1 | 3/2022 | Landies et al. | |
| 11,598,600 B2 | 3/2023 | Landies et al. | |
| 2016/0305725 A1* | 10/2016 | Patel | F41A 9/29 |
| 2019/0331450 A1 | 10/2019 | Steimke et al. | |
| 2025/0093117 A1* | 3/2025 | Steinhauser | F41A 19/46 |

FOREIGN PATENT DOCUMENTS

| | | |
|---|---|---|
| EP | 3477239 | 1/2019 |
| WO | 2021045851 | 3/2021 |

OTHER PUBLICATIONS

M37: The Ultimate Improved Browning 1919; https://surplused.com/index.php/2019/03/08/m37-the-ultimate-improved-browning-1919; Mar. 8, 2019; www.surplused.com; [Retrieved Jun. 27, 2025].
MG34 reversible feeds; https://www.k98kforum.com/threads/mg34-reversible-feeds.3046/; Sep. 11, 2011; www.k98kforum.com; [Retrieved Jun. 27, 2025].

(Continued)

*Primary Examiner* — J. Woodrow Eldred
(74) *Attorney, Agent, or Firm* — David O. Simmons; IVC Patent Agency

(57) ABSTRACT

Disclosed herein is a firearm including a main body having attached thereto a trigger group, a belt feed mechanism, a bolt carrier group, a barrel extension group, a belt box mount, and a stock assembly. The trigger group engages a bottom face of the main body. The trigger group enables fully-automatic mode of operation or select-fire modes of operation (automatic and semi-automatic). The belt feed mechanism is user-selectively engaged with a left-side or a right-side engagement interface of the main body. A top portion (e.g., top surface) of the belt box mount may engage a mating interface at a bottom portion (e.g., bottom surface) of the main body for fixedly engaging the belt box mount to the main body in a manner that inhibits vertical separation of the belt box mount from the main body The stock assembly is engaged with a rear end portion of the main body.

20 Claims, 21 Drawing Sheets

(56) References Cited

OTHER PUBLICATIONS

The HK21E, HKs best Beltfed; https://www.youtube.com/watch?v=no63zaxmBGE; Sep. 25, 2021; www.youtube.com; [Retrieved Jun. 27, 2025].
M240C; https://www.usord.com/weapons/m240c; 2025; www.usord.com; [Retrieved Jun. 27, 2025].
Ohio Ordnance Works REAPR MG—The "Grim Reaper" from the USA prefers the .338 Norma Magnum caliber. Why?; https://www.all4shooters.com/en/shooting/pro-zone/ohio-ordnance-works-reapr-mg-in-norma-magnum/; Feb. 28, 2024; www.all4shooters.com; [Retrieved Jun. 27, 2025].

* cited by examiner

CALIBER AND FEED-SIDE CONVERTIBLE FIREARM

FIELD OF THE DISCLOSURE

The disclosures herein relate generally to firearms, and more particularly to firearms having a receiver system offering belt feed capability, and still more specifically to belt-fed firearms that may have magazine and/or caliber conversion implemented by a user (i.e., a shooter) without the need of special gunsmith or armorer skills, and still yet more specifically to belt-fed firearms that may have a belt feeding mechanism switchable between left and right feed sides by a user without the need of special gunsmith or armorer skills, and yet further specifically to firearms having a modular receiver system for offering disclosed capabilities and/or operabilities.

BACKGROUND

Various types of tradition (i.e., legacy) machine guns are well known in the art. Such machine guns are firearms characterized as including or being exclusively configured to operate in a fully automatic firing mode. The fully automatic firing mode entails firing of rounds of ammunition automatically with a single pull of a trigger in a manner that facilitates ejection of each spent round from the firing chamber and chambering of a new round into the firing chamber without any operator action for providing such ejection of each spent round from the firing chamber and chambering of a new round into the firing chamber. To this end, as long as the trigger of the machine gun is depressed, the machine gun continues to fire rounds of ammunition until all available ammunition of a provided source of ammunition (e.g., magazine or belt) is depleted.

Some legacy machine guns such as the Browning M2 have provided over a century of service. Many other legacy machine guns were introduced during World War II and the Cold War period. Examples of such machine guns include the German MG-34 and Mg-42, the US M60, and the Belgian/US M240 and M249. Until relatively recently (in approximately the past 25 years), it has been unusual, if not unheard of, to mount any kind of optical sighting device to a belt-fed platform. Thus, to ease access to the feed mechanism, those weapons featured an opening top cover which was almost always mounted to an axis transverse to the barrel. However, present-day machine guns are expected to operate with optic devices (e.g., optical sights), which often creates a problem for legacy weapons because the top cover design they virtually all share does not provide a reliable, repeatable platform for mounting optic devices. Also, many legacy machine guns are chambered for 7.62×51 mm NATO rounds that are well known to be constrained in performance by design and to be compatible with the standard infantry rifles as well as the aforementioned legacy machine guns. Furthermore, legacy machine guns are heavier than is now necessary or preferred because housings and other components are made from outdated materials using outdated manufacturing techniques. Still further, by their design, legacy machine guns introduce substantial compromises in mounting to provide space for cartridge feeding and ejection.

Therefore, a machine gun platform that overcome shortcomings of legacy machine guns would be advantageous, desirable and useful.

SUMMARY OF THE DISCLOSURE

Advances in technology, changing battlefields, and the emergence of great power competition through hybrid warfare are examples of combat considerations that have altered the current needs of the warfighter across the board. Advantageously, embodiments of the disclosures made herein are directed to a machine gun platform that address such current needs of the warfighter. Key attributes of such machine gun platform includes, but are not limited to, being compatible with currently-available optic and imaging devices, being equally usable on foot or from a host of mobile platforms, being configured to engage targets from greater distances than are legacy machine guns, being able to defeat hard body armor and light vehicle armor, and being able to counter now-ubiquitous drone threats.

Preferably, a machine gun platform in accordance with embodiments of the disclosures made herein are user-convertible between two or more calibers and are user-configurable for feed-side preference (left-side feed or right-side feed) and/or user-specific dexterity (e.g., right-handed trigger finger or left-handed trigger finger). Additionally, structural bodies of such machine guns are preferably made from lightweight materials such as, for example, aluminum, titanium, composite materials, polymer (e.g., plastic) materials, and the like. Accordingly, relative to legacy machine guns, a machine gun platform in accordance with embodiments of the disclosures made herein are configured to offer: 1.) rigid optics mounting, 2.) user-configurable dexterity fitment and/or feed side preference, 3.) improved ballistic performance, 4.) lighter firearm weight, 5.) mounting on top of legacy applications like ground and naval vehicles, 6.) compatibility with an ever-expanding variety of host systems, including remote weapons stations and drones, and 7.) ability to supply belt-fed ammunition from low profile ammunition boxes. These attributes of a machine gun platform in accordance with embodiments of the disclosures made herein beneficially result in considerable advancements in performance and reliability as compared to legacy machine guns.

In one or more embodiments, a firearm comprises a main body having opposing belt-feed assembly mounting structures and a belt feed assembly selectively engageable with either one of the belt feed assembly mounting structures for enabling belt-fed ammunition to be supplied from the belt feed assembly when engaged with either one of the belt feed assembly mounting structures.

In one or more embodiments, a first one of the belt feed assembly mounting structures is located on a left side of the main body and a second one of the belt feed assembly mounting structures is located on a right side of the main body.

In one or more embodiments, the belt feed assembly has a symmetric construction relative to a plane that vertically bisects the belt feed assembly and that extends parallel to an ammunition feed direction of the belt feed assembly.

In one or more embodiments, a belt box mount engaged with the main body at a fixed position of the main body, wherein the belt box mount being engaged with the main body at the fixed position enables the belt box mount to secure the belt feed assembly in engagement with both of the belt feed assembly mounting structures.

In one or more embodiments, a bolt carrier is slidably engaged with the main body between the opposing belt feed assembly mounting structures and the bolt carrier includes belt mechanism motion control surfaces on opposing sides thereof.

In one or more embodiments, a barrel attached to the main body, a bolt carrier group operably attached to the main body between the opposing belt feed assembly mounting structures, and the belt feed assembly and the bolt carrier group are jointly operable to supply ammunition to a chamber of the barrel when the belt feed assembly is engaged with either one of the belt feed assembly mounting structures In one or more embodiments, the bolt carrier group is engaged with the main body at a fixed position relative to the position of the belt feed assembly.

In one or more embodiments, a bolt carrier is slidably engaged with the main body between the opposing belt feed assembly mounting structures, the bolt carrier includes a first set of belt mechanism motion control surfaces on a first side of the bolt carrier and a second set of belt mechanism motion control surfaces on a second side of the bolt carrier opposite the first side thereof, movement control surfaces of a feed lever of the belt feed assembly engage the first set of belt mechanism motion control surfaces when the belt feed mechanism is engaged with a first one of the belt feed assembly mounting structures, and the movement control surfaces of the feed lever engage the second set of belt mechanism motion control surfaces when the belt feed mechanism is engaged with a second one of the belt feed assembly mounting structures.

These and other objects, embodiments, advantages and/or distinctions of the present invention will become readily apparent upon further review of the following specification, associated drawings and appended claims.

DETAILED DESCRIPTION

Figure 1:
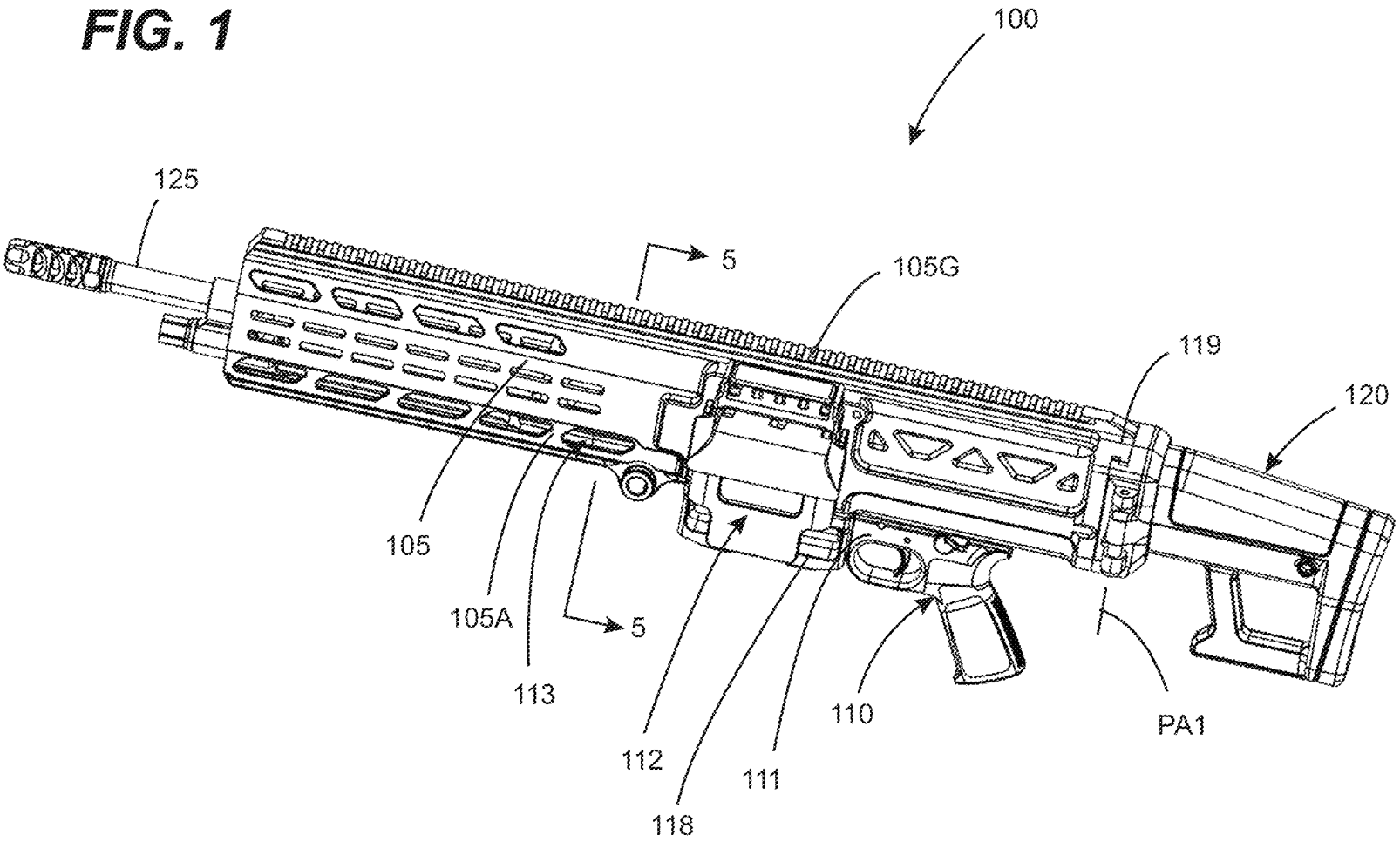
FIG. 1 is a first left-side perspective view of a firearm in accordance with one or more embodiment of the present invention, having a left-side belt feeding arrangement.
Figure 2:
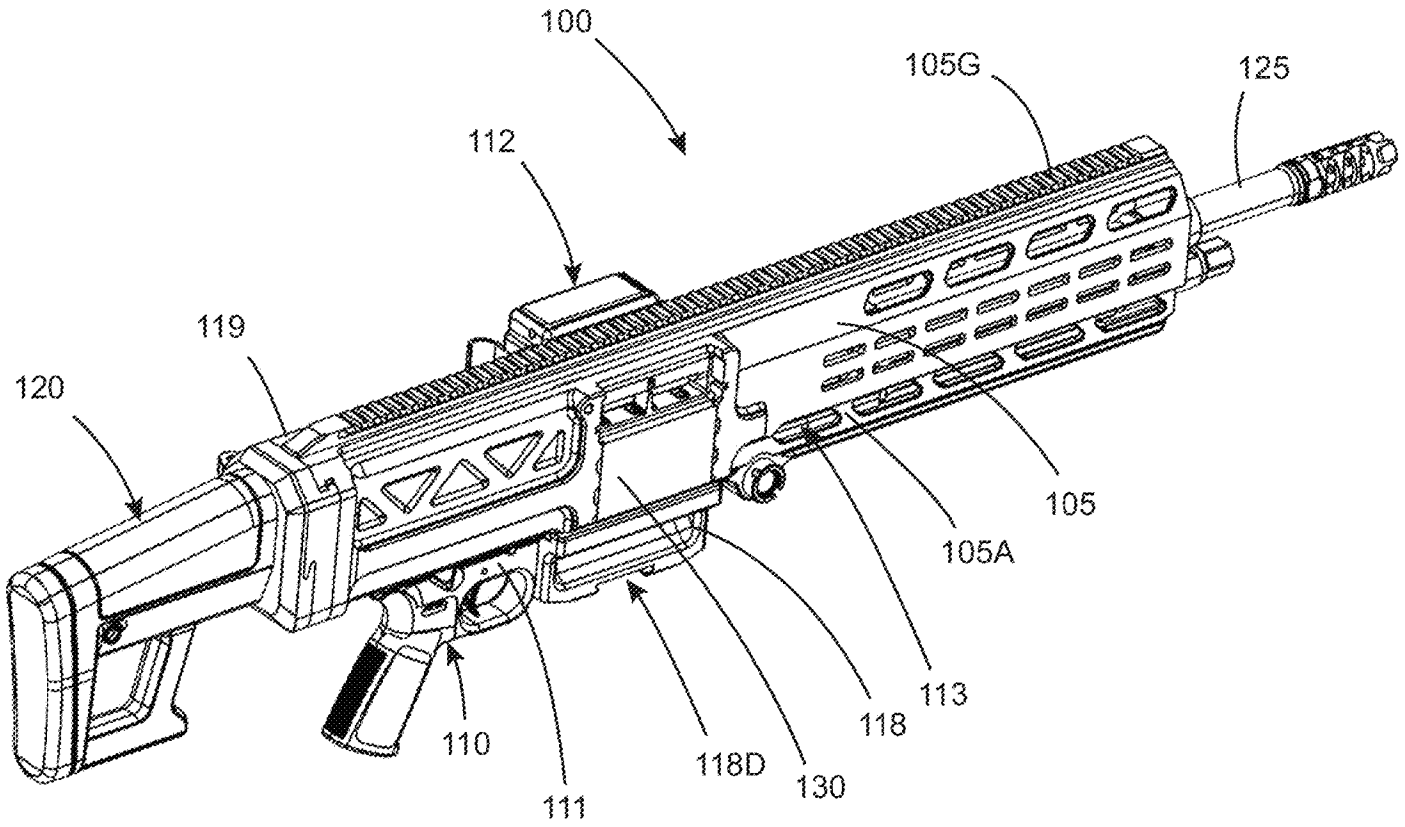
FIG. 2 is a first right-side perspective view of the firearm shown and configured as in FIG. 1.

Embodiments of the disclosures made herein are directed to a machine gun platform that is user-adaptable, powerful, compact, and lightweight. For example, in at least one embodiment, a machine gun platform will offer key attributes enabling machine guns of the platform to replace 7.62 MM legacy machine guns. To this end, in some embodiments, machine guns of the platform will offer the following attributes: 1.) be primarily chambered for 0.338 Norma Magnum rounds of ammunition, 2.) have a weight of approximately 20 lbs. (9 kg) or less, 3.) be foldable into a size about that or smaller than that of an M4 Carbine, 4.) be user-convertible to use 7.62 mm ammunition, 5.) be user-configurable to left-feed or right-feed, 6.) accept all modern accessories and modifications, and 7.) include a continuous rigid optics rail integral to and across the full length of the receiver housing for enabling rigid mounting of rail-mountable accessory devices (e.g., high-magnification optics and night vision/thermal devices).

A machine gun (i.e., firearm) in accordance with an embodiment of the disclosures made herein may possess the following specifications:

| | |
|---|---|
| Caliber | .338 Norma Magnum (convertible to 7.62 × 51 mm NATO) |
| Bolt Group Design Pressure | At least about 80,000 psi (550 MPa) |
| Action | Short-stroke tappet gas piston (adjustable use both with and without a sound suppressor); rotating bolt |
| Barrel System | Quick-change barrel |
| Headspace | Fixed |
| Feed System | Linked ammunition, configurable for left- or right-hand feed |

-continued

| | |
|---|---|
| Firing Mode | Select-Fire |
| Rate of Fire | About 500-600 rounds per minute |
| Barrel Length | 17 in. (~6.7 cm)or 24 in. (~9.5 cm) |
| Length | About 17" (~6.7 cm) BBL: 41.5" (~16.3 cm) and 34" (~13.4 cm) folded about 24" (~9.5 cm) BBL: 46.5" (~18.3 cm) and 39" (~15.4 cm) folded |
| Weight | About 20 pounds (9 kg) or less |
| Muzzle Velocity | At least about 2,650 ft/s (2,550 ft/s from 17" BBL) |
| Effective Firing Range | At least about 2,000 m |
| Maximum Firing Range | At least about 7,130 m |
| Stock | Collapsible/Adjustable/Non-integral to the action |

Another machine gun (i.e., firearm) in accordance with an embodiment of the disclosures made herein may possess the following specifications:

| | |
|---|---|
| Caliber | 7.62 × 51 mm NATO (convertible to 5.56 × 45 mm NATO) |
| Bolt Group Design Pressure | At least about 80,000 psi (550 MPa) |
| Action | Short-stroke tappet gas piston (adjustable use both with and without a sound suppressor); rotating bolt |
| Barrel System | Quick-change barrel |
| Headspace | Fixed |
| Feed System | Linked ammunition, configurable for left- or right-hand feed |
| Firing Mode | Select-Fire |
| Rate of Fire | About 500-600 rounds per minute |
| Barrel Length | 16 in. or 22 in. |
| Weight | About 14 pounds (9 kg) or less |
| Muzzle Velocity | 2,850 ft/s from 16 in barrel |
| Effective Firing Range | At least about 1,000 m |
| Maximum Firing Range | At least about 3,820 m |
| Stock | Collapsible/Adjustable/Non-integral to the action |

The preferred chambering for a firearm in accordance with embodiments of the disclosures made herein is the 0.338 Norma Magnum cartridge. The 0.338 Norma Magnum ammunition offers nearly double the muzzle energy (6,400 J vs 3,500 J) of a 7.62 NATO ammunition and low drag bullets. The 0.338 Norma Magnum ammunition doubles the effective range from 1,000 meters to 2,000 meters as compared to 7.62 NATO ammunition, and improves target effect in every respect, at every range. Barrier, anti-materiel, and anti-armor effects are all considerably improved with the 0.338 Norma Magnum ammunition as compared to the 7.62 NATO ammunition. The 0.338 Norma Magnum ammunition of a comparable type (ecartridge, AP) provides a 150-200% increase in penetration capability as compared to 7.62 mm NATO ammunition, including the ability, with tungsten cored armor piercing ammunition, to penetrate Level IV body armor at four times the distance of comparable 7.62 NATO tungsten cored ammunition. The projectile of 0.338 Norma Magnum ammunition provides more than double the available jacket volume for energetic filler materials such as, for example, pyrotechnic incendiaries and explosive compounds.

Preferably, firearms in accordance with embodiments of the disclosures made herein may weigh about 20 pounds (9 kg) unloaded. At 20 pounds, firearms in accordance with embodiments of the disclosures made herein are approximately 5-8 pounds (2.5-3.6 kg) lighter than legacy 7.62×51 mm NATO machine guns, despite being chambered for ammunition approximately twice as powerful. Advantageously, these attributes allow firearms in accordance with embodiments of the disclosures made herein to be used in all or nearly all applications where a legacy 7.62×51 mm NATO machine gun would be used and allowing the infantry soldier to carry more ammunition. For example, firearms in accordance with embodiments of the disclosures made herein are markedly lighter whereby, for the weight of a legacy machine gun with no ammunition, a firearm in accordance with embodiments of the disclosures made herein and about 60 rounds of 0.338 ammunition could be carried instead.

FIGS. 1-24 show various aspects of a firearm in accordance with one or more embodiments of the disclosures made is shown—i.e., the firearm 100. The firearm 100 may be a carbine and includes structural and operational components that enable the aforementioned structural and operational attributes. In this regard, the firearm 100 readily and efficiently overcome shortcomings of legacy machine guns.

As best shown in FIGS. 1-9, the firearm 100 (e.g., operable in a semi-automatic, fully automatic, or select-fire mode) includes a main body 105, having attached thereto a trigger group 110, a belt feed mechanism 112, a bolt carrier group 113, a barrel extension/trunnion group 115, a belt box mount 118, and a stock assembly 120. The trigger group 110 engages a bottom face of the main body 105 and may be proprietary or commercially-available trigger group that enables fully-automatic mode of operation or select-fire modes of operation (automatic and semi-automatic). The belt feed mechanism 112 is engaged with a chosen one of a left-side engagement interface of the main body 105 and a right-side engagement interface of the main body 105. A top portion (e.g., top surface) of the belt box mount 118 may engage a mating interface at a bottom portion (e.g., bottom surface) of the main body 105 for fixedly engaging the belt box mount 118 to the main body 105 in a manner that inhibits vertical separation of the belt box mount 118 from the main body 105. The stock assembly 120 is engaged with a rear end portion 119 of the main body 105—e.g., foldably about a stock pivot axis PA1. To this end, the rear end portion 119 of the main body 105 includes engagement surfaces configured for being engaged with mating engagement surfaces of the stock assembly 120 engaged therewith.

Figure 3:
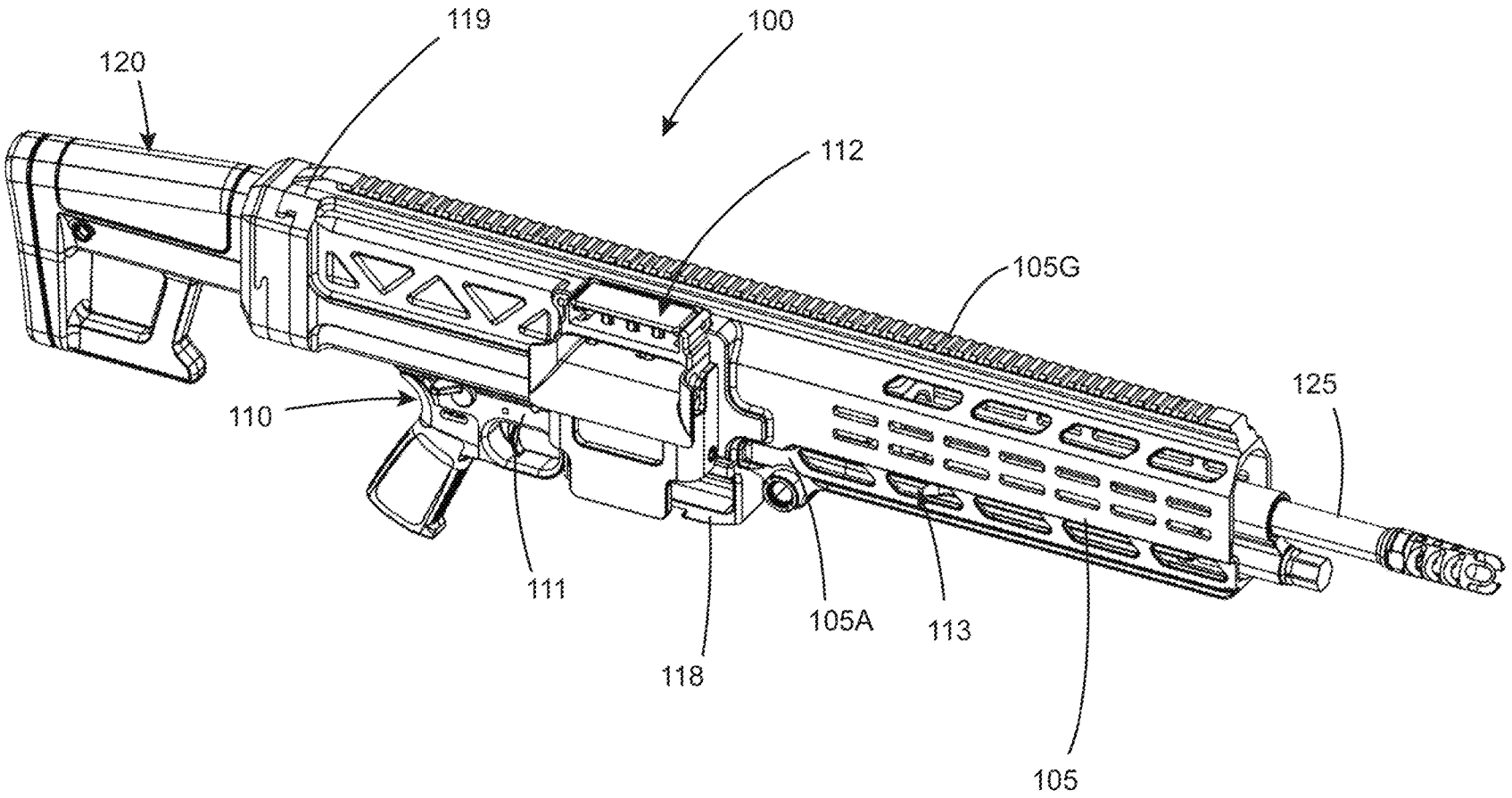
FIG. 3 is a second right-side perspective view of the firearm shown in FIG. 1, having belt feed mechanism thereof re-configured to have a right-side belt feeding arrangement.
Figure 4:
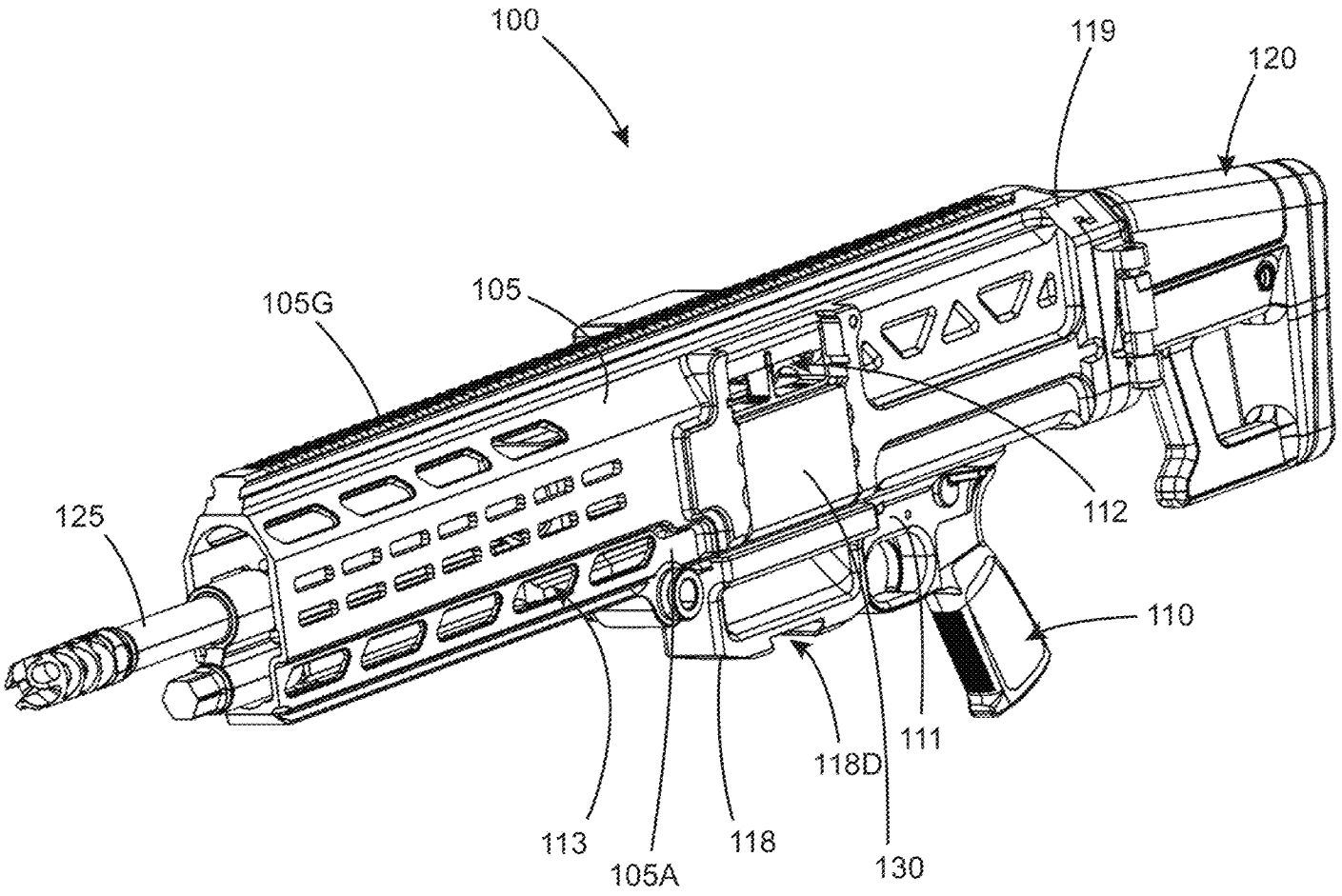
FIG. 4 is a second left-side perspective view of the firearm shown and configured as in FIG. 3.

The main body 105, the trigger group 110, the belt feed mechanism 112, the bolt carrier group 113, the barrel extension/trunnion group 115, the belt box mount 118, and the stock assembly 120 are jointly configured for enabling the belt feed mechanism 112 to be operably mounting on the main body in a left-side belt feeding arrangement (FIGS. 1 and 2) and in a right-side belt feeding arrangement (FIGS. 3 and 4). To this end, the belt feed mechanism 112 may have a mirror-image construction as viewed from a centerline that vertically bisects the belt feed mechanism 112. To support such left-side and right-side belt feeding arrangement using a single belt feed mechanism (e.g., the belt feed mechanism 112), the bolt carrier group 113 and the barrel extension/trunnion group 115 may be centrally mounted and positioned on the main body 105 for enabling use in the left-side and right-side belt feeding arrangements without need for re-arrangement of the bolt carrier group 113 or the barrel extension/trunnion group 115.

Figure 5:
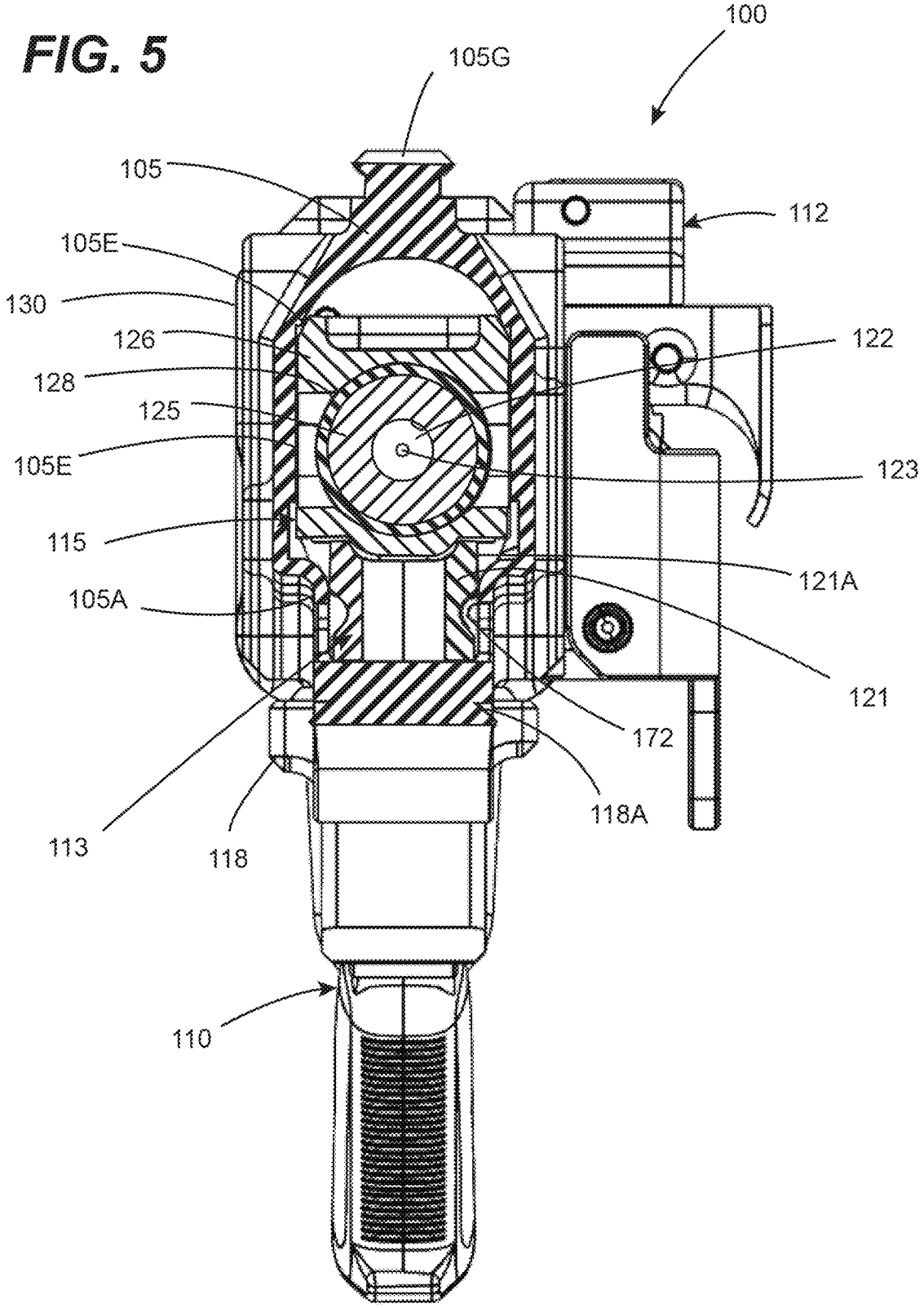
FIG. 5 is a cross-sectional view taken along the line 5-5 in FIG. 1
Figure 6:
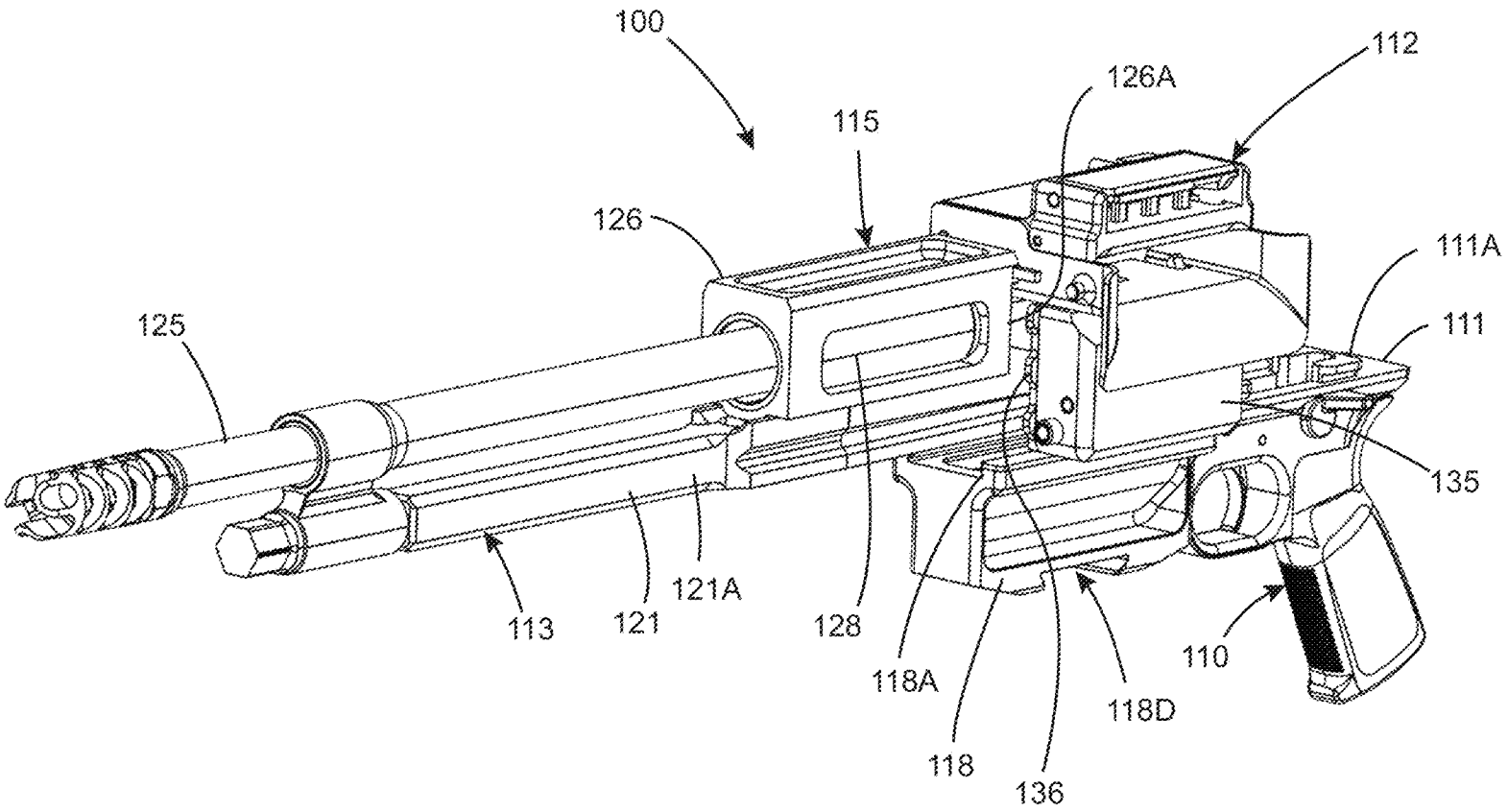
FIG. 6 is a front perspective view of the firearm shown in FIGS. 1-4 with the main body and stock assembly omitted.
Figure 7:
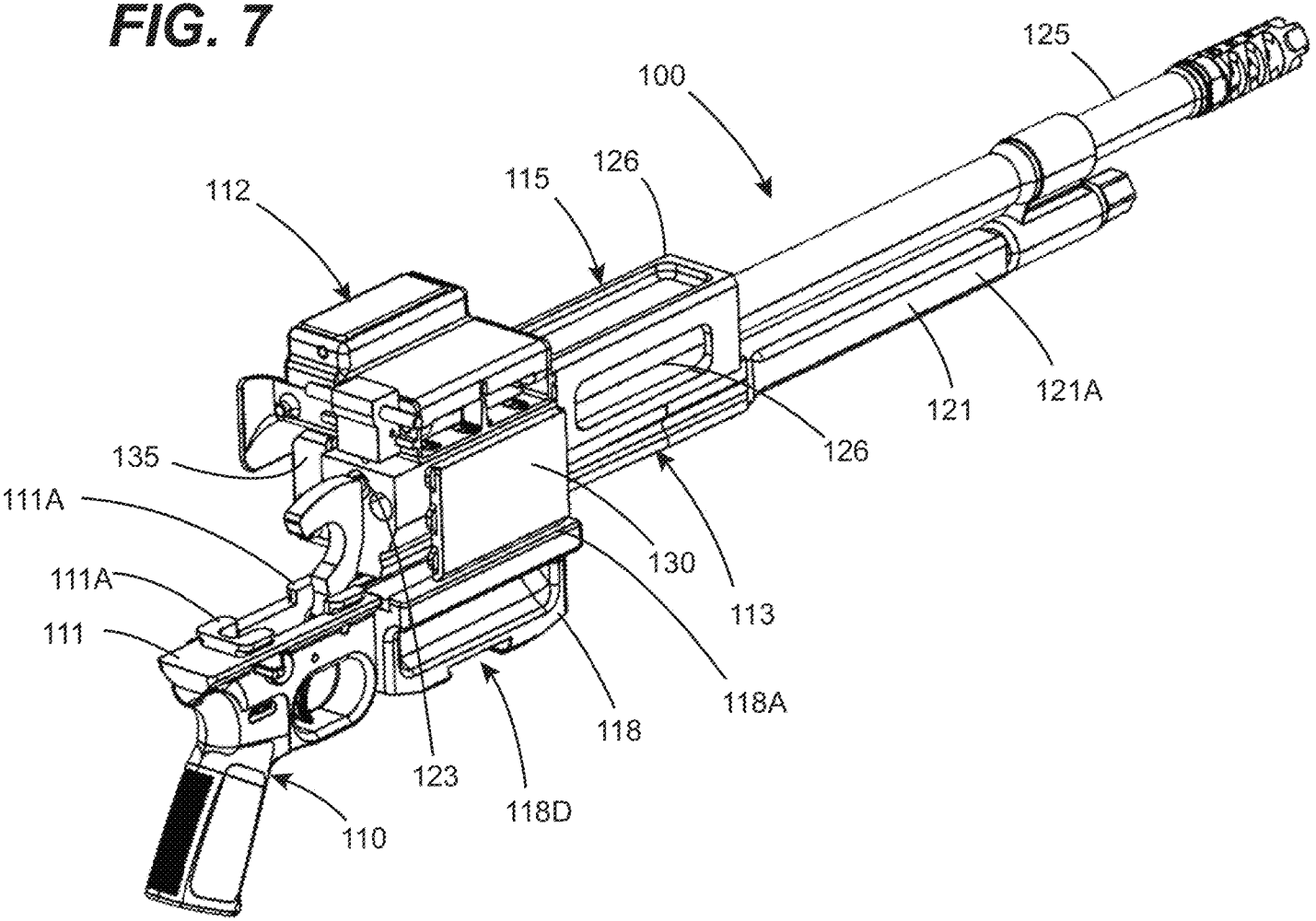
FIG. 7 is a rear perspective view of the firearm shown in FIGS. 1-4 with the main body and stock assembly omitted.

As best shown in FIGS. 5-10, the barrel extension/trunnion group 115 includes a barrel extension frame 126 (e.g., a trunnion or similar structural element) and a barrel extension 128 fixedly secured within the barrel extension frame 126. As best shown in FIG. 5, the barrel extension frame 126 is disposed within the main body 105. Exterior engagement surfaces 126A (FIGS. 6, 9, 11, 12) of the barrel extension frame 126 may engage mating interior engagement surfaces 105E (FIGS. 5 and 23) of the main body 105 for constraining one or more of horizontal, vertical, and rotational movement of the barrel extension frame 126 relative to the main body 105. One or more mechanical fasteners such as, for example, pins, screws, bolts, or any combination thereof, or alternatively keyed physical features such as flanges, bosses and pockets or the like may be used to constrain axial movement along the length of the main body 105. As is well known in the art, the barrel 125 may be treadedly engaged with the barrel extension 128.

Figure 10:
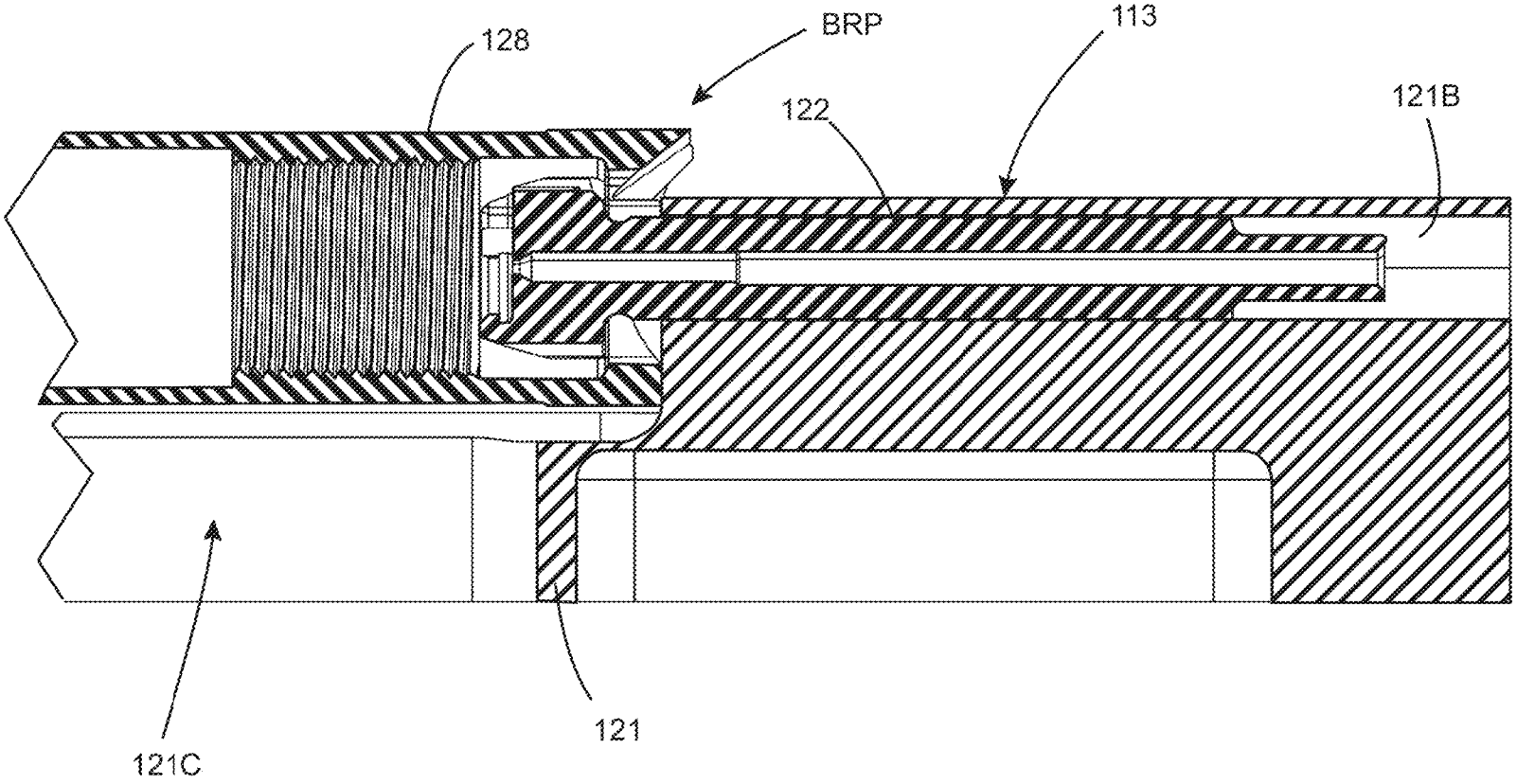
FIG. 10 is a fragmentary cross-sectional view of a bolt carrier group (firing pin omitted) and a barrel extension group of firearm shown in FIGS. 1-4.
Figure 11:
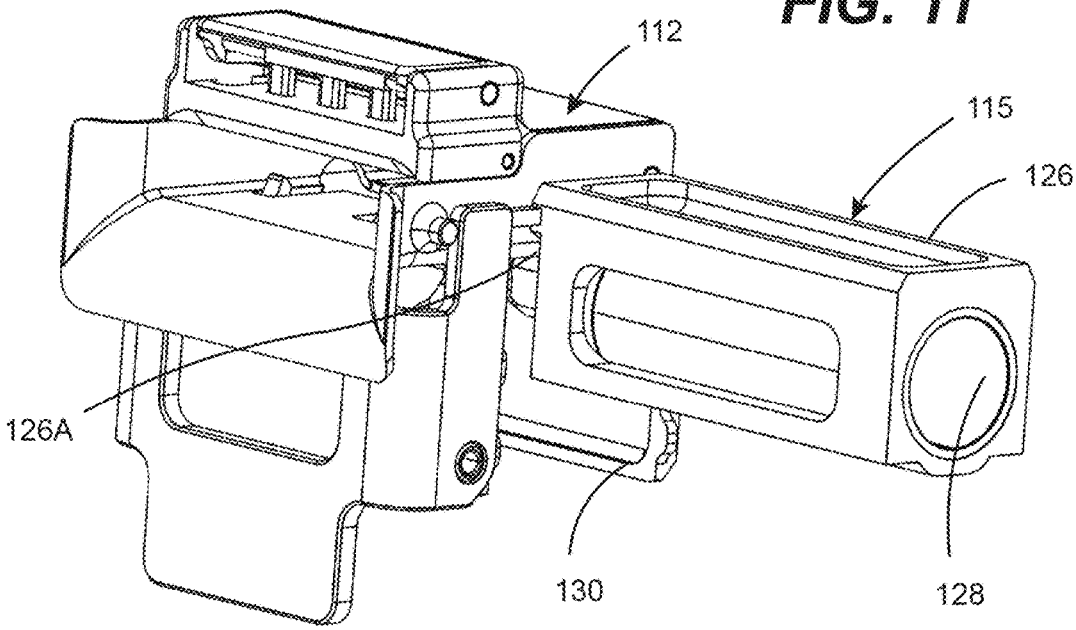
FIG. 11 is a right-side perspective view of belt feeding and chambering assemblies mountable on the main body of the firearm shown in FIGS. 1-4, where the belt feeding assembly is situated to provide a right-side belt feeding arrangement.

Referring to FIGS. 5-12, the bolt carrier group 113 includes a bolt carrier 121, a bolt 122, and a firing pin 123. The bolt carrier 121 is slidably engaged with mating surfaces of the main body 105 for enabling the bolt carrier 121 to move between a battery-enabling position BRP (a fully-forward position in use) and a rearward (e.g., recoil) position where the bolt carrier 121 is displaced toward the rear of the firearm 100. As also shown in FIG. 10, lugs of the bolt 122 becomes lockedly engaged with mating lugs of the barrel extension 128. As best shown in FIG. 5, opposing guide surfaces 121A of the bolt carrier 121 may be slidably engaged with mating guide walls 105A of the main body 105 for enabling the bolt carrier 121 to be slidable with respect to the main body 105. Rearward movement of the bolt carrier is energized by gas emitted from a gas block 133 (e.g., adjustable for varying levels of gas discharge) that impinges upon a forward face of the bolt carrier 121. As is well known in the art, the bolt 122 is rotatably and slidable disposed within a central passage 121B (FIG. 10) of the bolt carrier 121.

Figure 8:
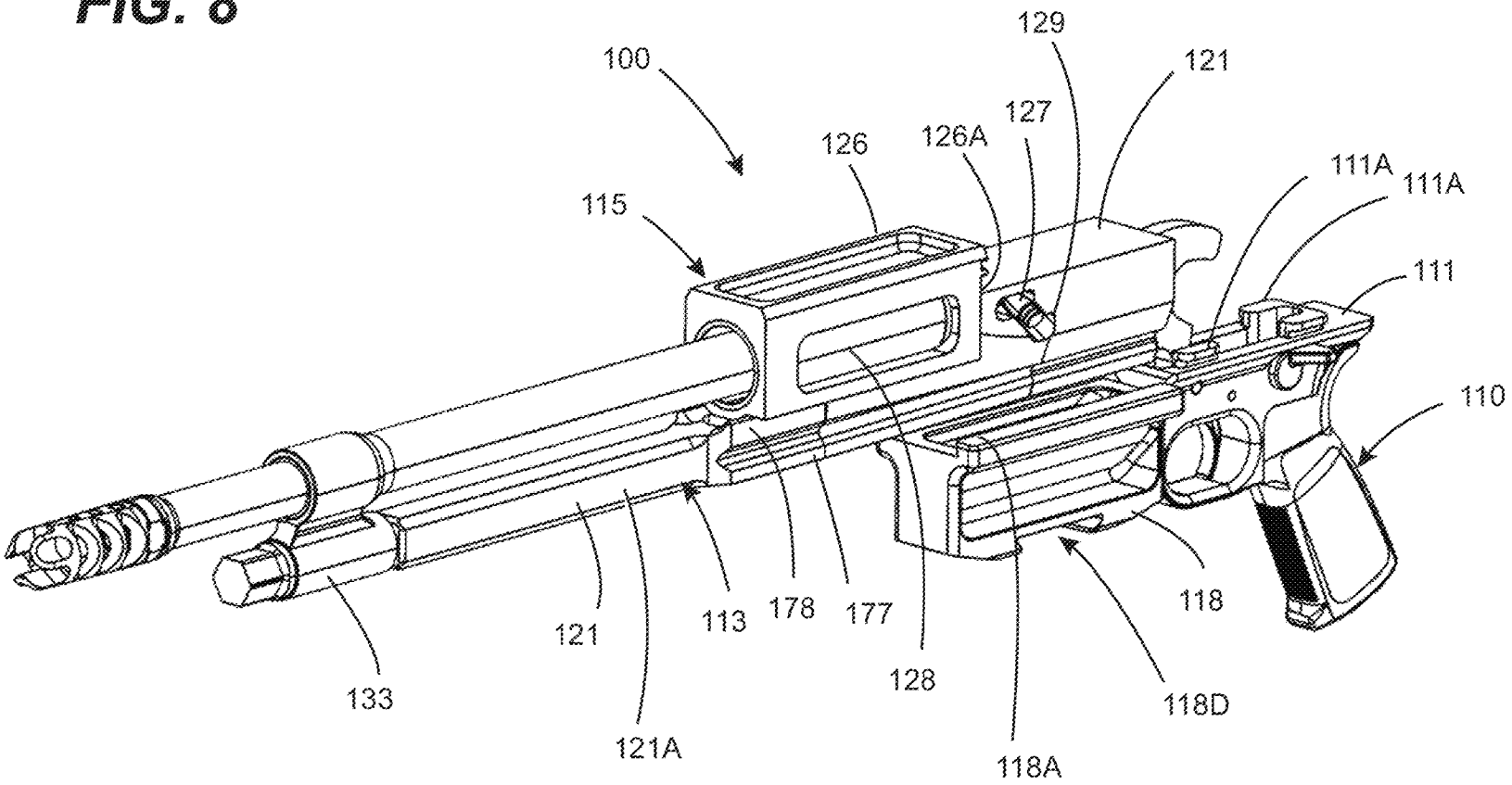
FIG. 8 is a front perspective view of the firearm shown in FIGS. 1-4 with the main body, stock assembly, and belt feed mechanism omitted.
Figure 9:
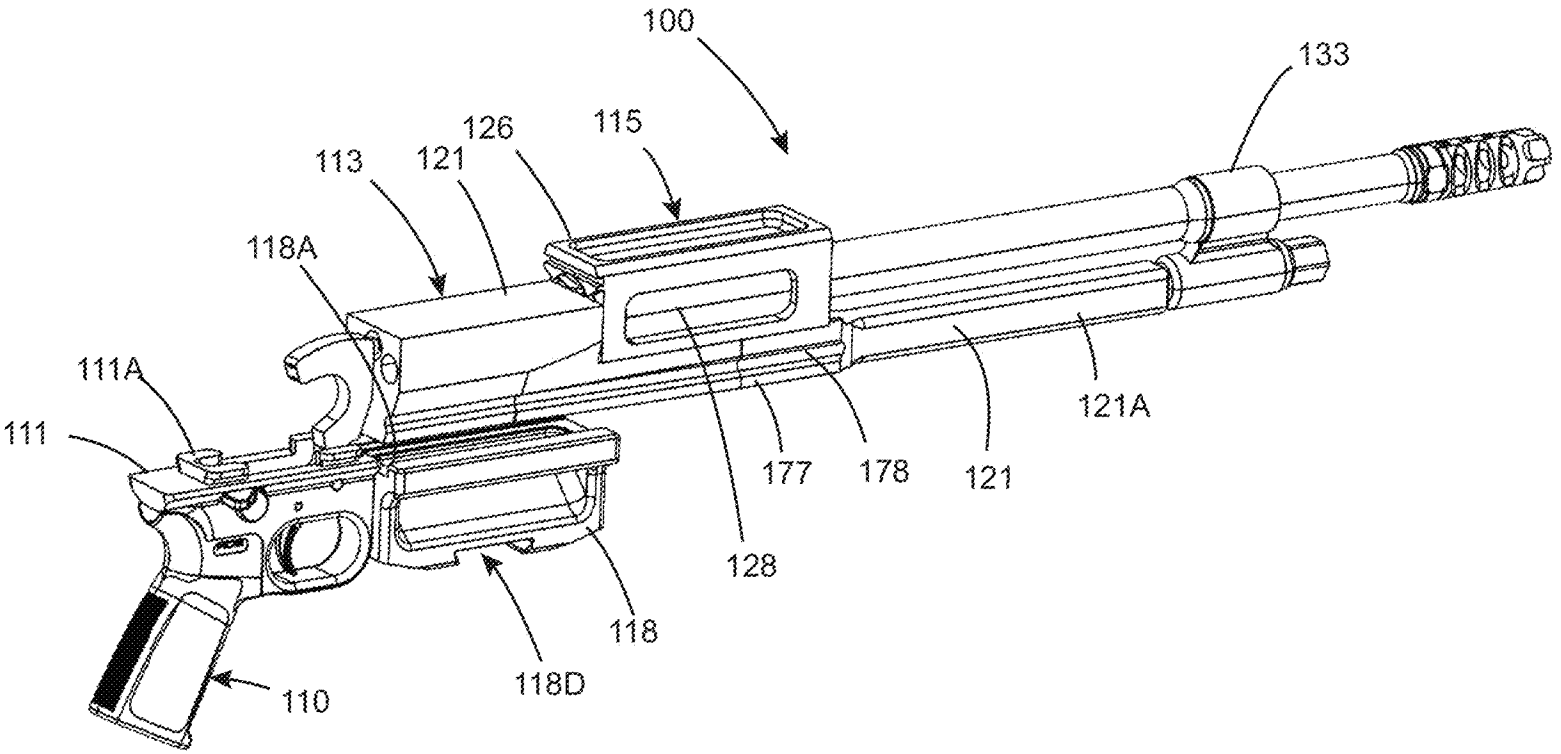
FIG. 9 is a rear perspective view of the firearm shown in FIGS. 1-4 with the main body, stock assembly, and belt feed mechanism omitted.
Figure 12:
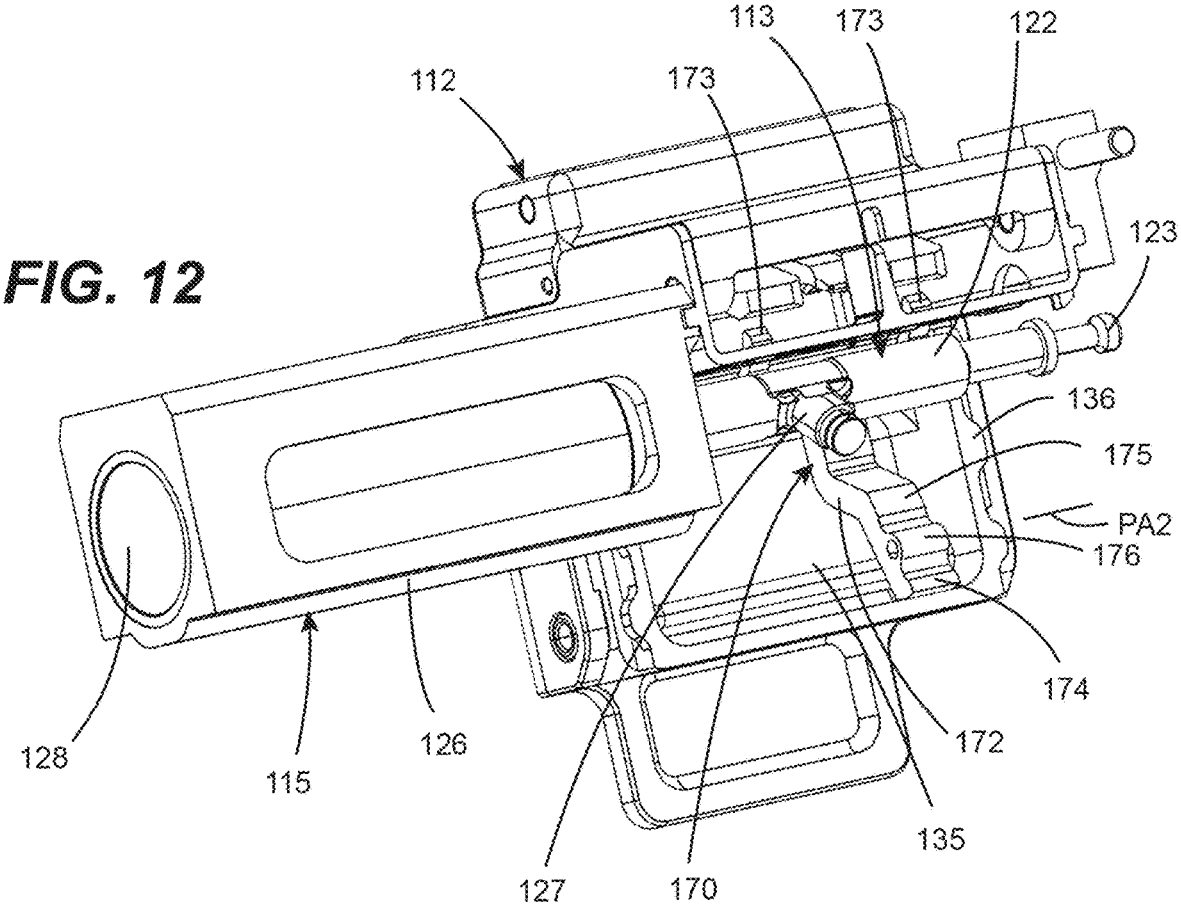
FIG. 12 is a left-side perspective view of the belt feeding and chambering assemblies of FIG. 11.
Figure 13:
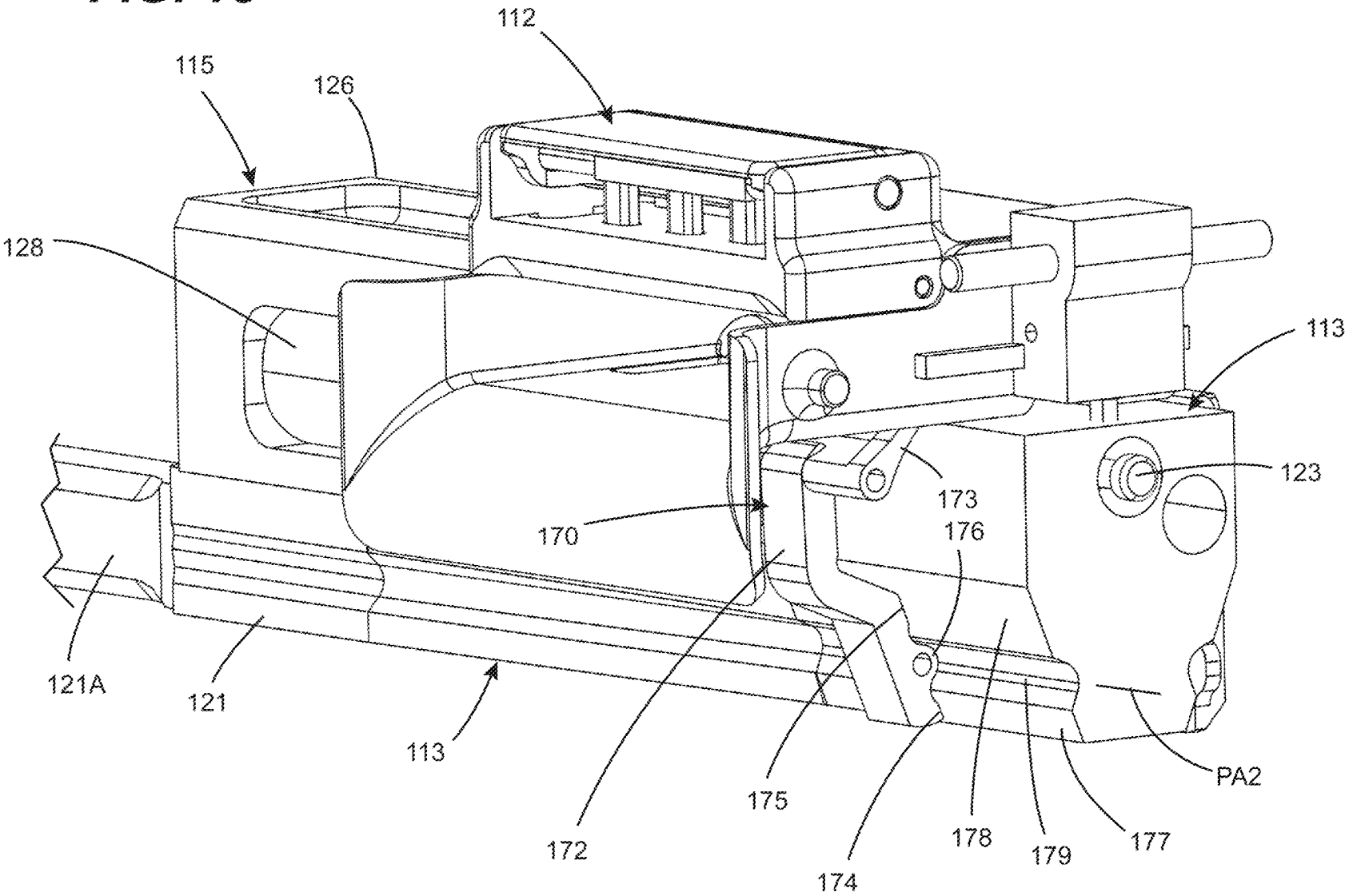
FIG. 13 is a rear perspective view of the belt feed mechanism, the bolt carrier group, and the barrel extension/trunnion group of the firearm shown in FIGS. 1-4, with a belt feed mechanism mounting body omitted.
Figure 14:
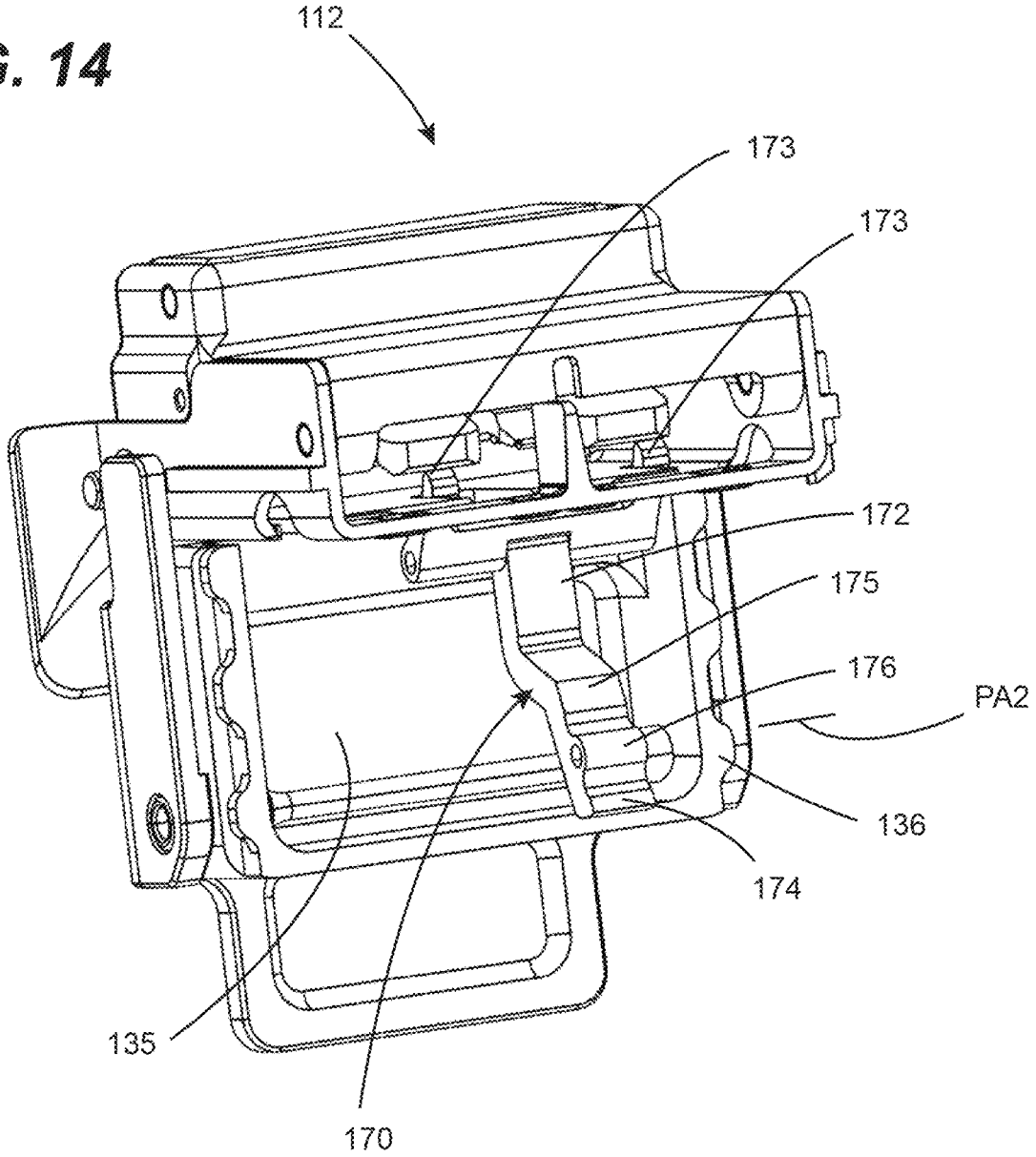
FIG. 14 is a rear perspective view of the belt feed mechanism of the firearm shown in FIGS. 1-4.

Referring to FIGS. 8 and 12, a cam pin 127 is fixedly engaged with the bolt 122 and extends at least partially through a camming slot 129 within a side wall of the bolt carrier 121. When the lugs of the bolt 122 are lockedly engaged with the mating lugs of the barrel extension 128, rearward movement of the bolt carrier causes engagement of the cam pin 127 and the camming slot 129 to result in rotational movement of the bolt 122 in a first rotational direction relative to the bolt carrier 121 for disengaging the lugs of the bolt 122 from the mating lugs of the barrel extension 128. With forward motion of the bolt carrier 121, the bolt 122 bears against the barrel extension 128 and further forward movement of the bolt carrier 121 causes engagement of the cam pin 127 and the camming slot 129 to result in rotational movement of the bolt 122 in a second rotational direction opposite the first rotational direction for lockedly engaging the lugs of the bolt 122 with the mating lugs of the barrel extension 128.

Referring now to FIGS. 1-5, the belt feed mechanism 112 is located above the belt box mount 118. The belt box mount 118 (see also FIGS. 18-19) includes an upper mounting structure 118A (e.g., dovetail interface) at its upper end portion that is engageable with a mating mounting structure 105B (see also FIGS. 20-23) of the main body 105. As best shown in FIGS. 2, 4, 6-9 and 18, the belt box mount 118 includes a lower mounting structure 118D (e.g., dovetail interface) at its lower end portion that is engageable with a mating mounting structure of a belt box or other source of belt feed ammunition. When the belt box mount 118 is in a fully-seated position relative to the main body 105, the belt feed mechanism 112 is constrained in a fixed position relative to the main body 105 by the belt box mount 118. When in the fully-seated position relative to the main body 105, the belt box mount 118 engages the belt feed mechanism 112 to secure the belt feed mechanism 112 in a fixed position (i.e., at least a fixed vertical position) relative to main body 105 regardless of whether the belt feed mechanism 112 is in the left-side belt feeding arrangement or the right-side belt feeding arrangement.

Figure 18:
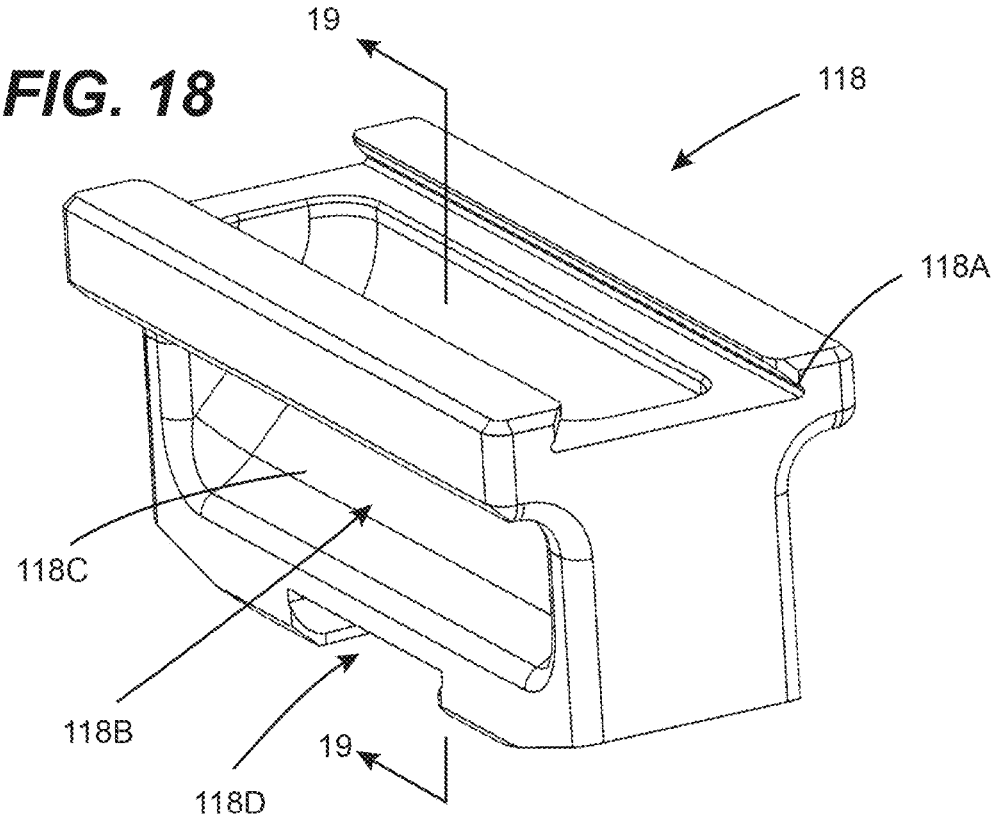
FIG. 18 is a perspective view of a belt box of the firearm shown in FIGS. 1-4.
Figure 19:
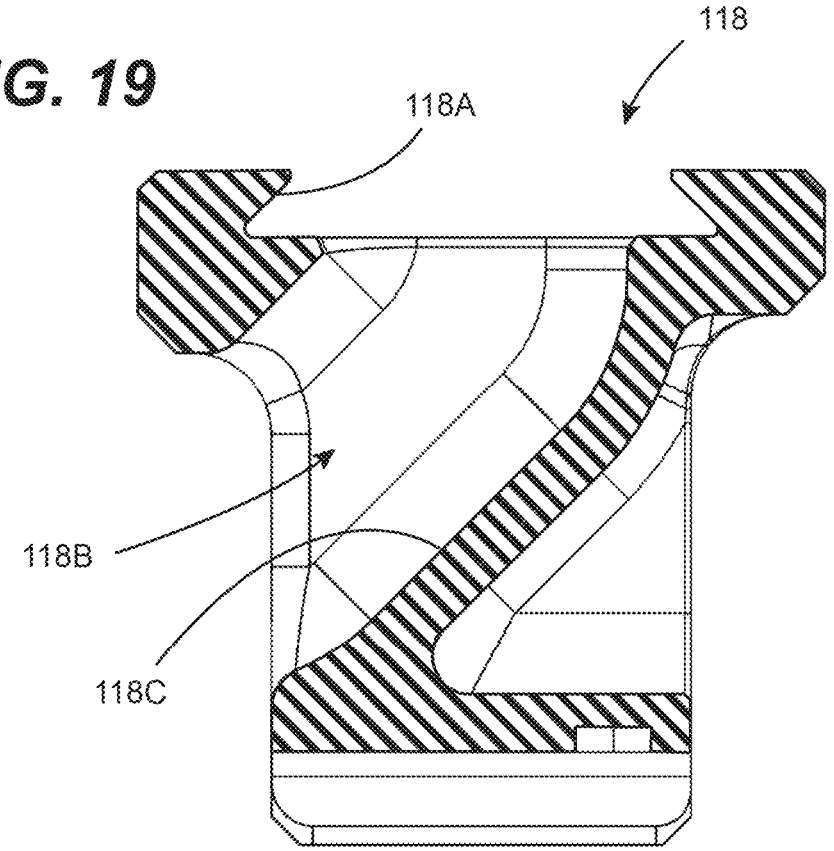
FIG. 19 is a cross-sectional view taken along the line 19-19 in FIG. 18.

As shown in FIG. 10, the bolt carrier 121 includes a casing passage 121C through which spent ammunition casings are ejected when the bolt carrier is displaced sufficiently rearward from the battery-enabling position BRP. The main body 105 includes a casing passage 105F (FIGS. 20-23) through which the spent ammunition casings are ejected (i.e., with the casing passage 121C of the bolt carrier 121 sufficiently aligned therewith). As best shown in FIGS. 18 and 19, the belt box mount 118 includes a casing passage 118B that is aligned with the casing passage 105F of the main body 105 when the belt box mount 118 is in the fully-seated position relative to the main body 105 for enabling the aforementioned ejection of the spent casings. The casing passage 121C of the bolt carrier 121, the casing passage 105F of the main body 105, and the casing passage 118B of the belt box mount 118 jointly define a contiguous casing passage when the bolt carrier is sufficiently displaced rearward from the battery-enabling position BRP. As shown in FIGS. 18 and 19, a floor of the casing passage 118B of the belt box mount 118 may be defined by a deflector wall 118C having a profile whereby the casing passage 118B of the belt box mount 118 exits at a side face of the belt box mount 118.

For securing the belt box mount 118 in the fully-seated position relative to the main body 105, the belt box mount 118 may be captured between a surface of the main body 105 and a surface of the trigger group 110 when the trigger group 110 is fixedly engaged with the main body in a seated operational position, as shown or it may alternatively be mounted to the main body 105 with transverse connecting pins. Thus, the belt box mount 118 may be captured between spaced-apart surfaces of the main body 105 and the trigger group 110 for securing the belt box mount 118 in the fully-seated position with respect to the main body 105 and thereby securing the belt feed mechanism 112 in the fixed position relative to the main body 105.

As best shown in FIGS. 20-23, left and right belt feed mechanism mounting portions 105CR, 105CL are provided for enabling fixed engagement of the belt feed mechanism 112 to the main body 105. For example, the left and right and right belt feed mechanism mounting portions 105CR, 105CL of the main body 105 may each be a flange that engages a mating flange 136 (FIGS. 12 and 14) of a belt feed mechanism mounting body 135. One of the engaged flanges may reside in a channel or slot behind the other one of the engaged flanges for thereby creating an engagement interface between the engaged flanges. Each of the flanges may include one or more engagement discontinuities (e.g., cutouts, protruding edges, wavy edges, serrated edges, or the like) for enabling and/or benefitting such engagement (e.g., reducing required length of longitudinal travel for such engagement. The left and right belt feed mechanism mounting portions 105CR, 105CL may each be integral with a respective side wall of the main body 105. A block-out body 130 (FIGS. 2, 4, 5, 7) may be engaged with the main body 105 at an opposite one of the belt feed mechanism mounting positions at which the belt feed mechanism 112 is mounted. In view of the disclosures made herein, a skilled person will appreciate other structural interfaces for enabling left-side and right-side belt feeding arrangements for firearms configured in accordance with embodiments of the disclosures made herein.

Relative to a plane vertically bisecting the main body 105 and extending parallel to an ammunition feed direction of the belt feed assembly (i.e., perpendicular to the pivot axis PA2 and/or to the centerline longitudinal axis of the barrel 125), left and right sides of the main body 105 may be mirror images in regard to such structural features for enabling the trigger group 110, the belt feed mechanism 112, the bolt carrier group 113, the barrel extension/trunnion group 115, the belt box mount 118, and the stock assembly 120 to be engaged therewith. It is disclosed herein that the main body 105 may be made using any one or more of several known techniques of manufacture including, but not limited to CNC machining, extruding, injection molding, casting, forging, and the like. The main body 105 may be formed as several discrete components and assembled into an integrated single body—e.g., formed as separate mirror image halves that combined into an integrated single body.

Figure 15:
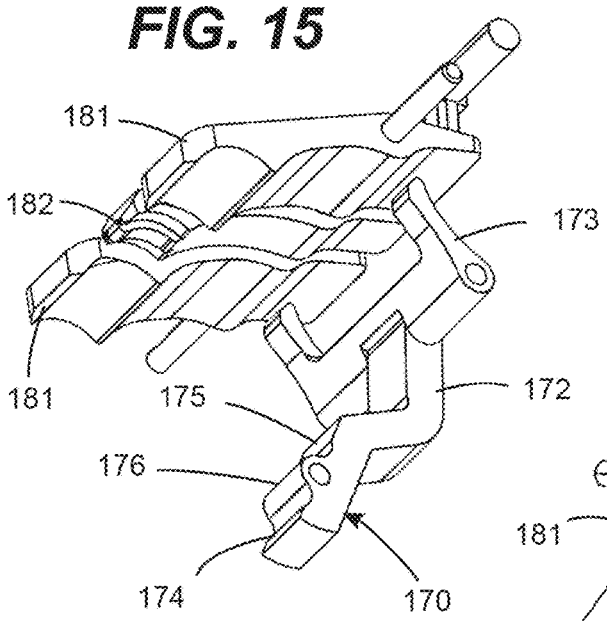
FIG. 15 is a first perspective view of a feed pawl and cartridge follower assemblies of the belt feed mechanism shown in FIGS. 11-14.
Figure 16:
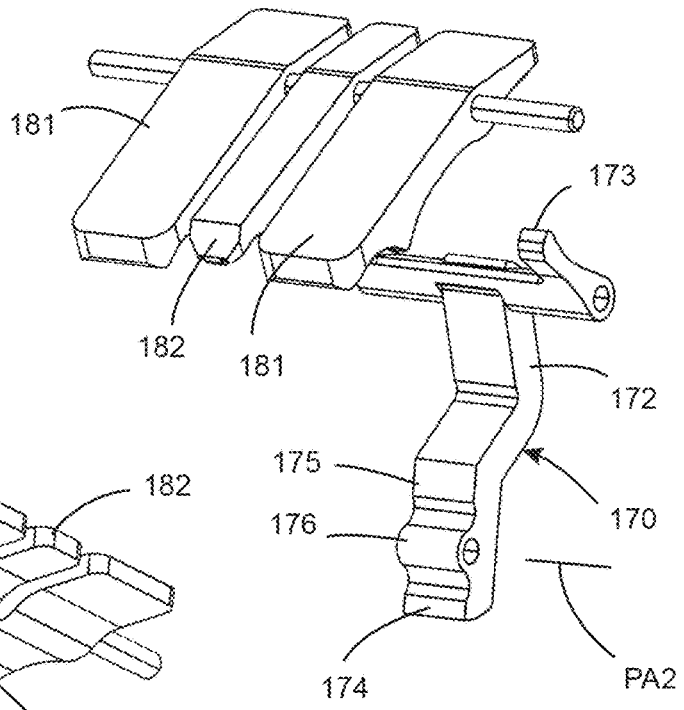
FIG. 16 is a second perspective view of the feed pawl and cartridge follower assemblies of the belt feed mechanism shown in FIGS. 11-14.
Figure 17:
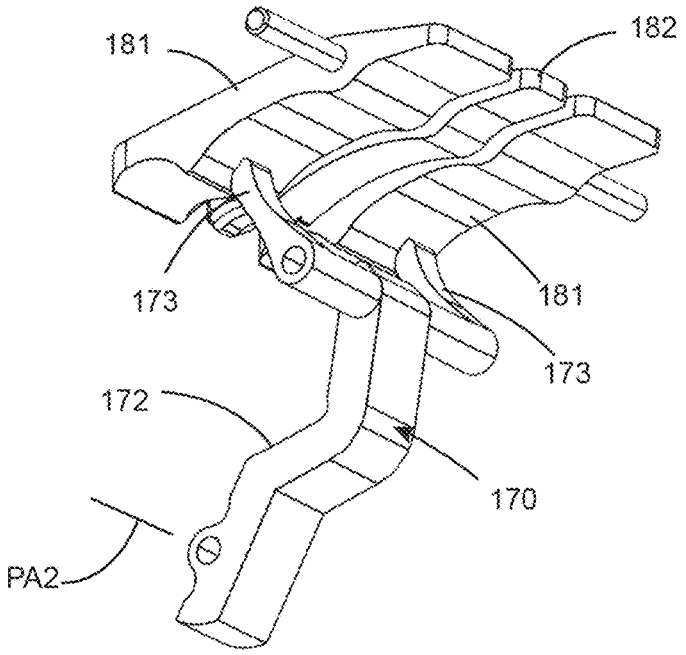
FIG. 17 is a third perspective view of the feed pawl and cartridge follower assemblies of the belt feed mechanism shown in FIGS. 11-14.

Referring now to FIGS. 11-17, various aspects of the structural components and operation of the belt feed mechanism 112. The feed mechanism includes a translating feed pawl assembly 170 including a pawl lever 172, spaced-apart feed pawls 173, a lower movement control surface 174, an upper movement control surface 175, and a pivot mount 176. The spaced-apart feed pawls 173 may be discrete from each other or part of a one-piece body. The lever pivot mount 176 is located between the lower movement control surface 174 and the upper movement control surface 175. The lever pivot mount 176 is pivotably engaged (e.g., via a pivot pin) with a mating fixed structure of the belt feed mechanism 112 (e.g., a lever mounting portion of the flange 136) or a fixed structure of the main body 105. As shown in FIGS. 15-17, the belt feed mechanism 112 includes spaced apart cartridge biasing pawls 181 and a central biasing pawl 182 therebetween. Notably, the components of the belt feed mechanism 112 may be preferably arranged for enabling conversion between left-side belt feeding and right-side belt feeding with a single instance of the belt feed mechanism 112. For example, the components can be arranged such that components (or portions thereof) on either side of a plane that vertically bisects are a mirror image of each other relative to the vertical plane.

The lower movement control surface 174 is engaged with a mating lower movement control surface 177 of the bolt carrier 121. The upper movement control surface 175 is engaged with a mating upper movement control surface 178 of the bolt carrier 121. The lever pivot mount 176 may be located within a recessed portion 179 of the bolt carrier 121 extending along a length of the lower movement control surface 174 and the upper movement control surface 175 therebetween. The lower movement control surface 174 and the upper movement control surface 175 both correspondingly rotate about a longitudinal reference axis thereof (i.e., longitudinally twist) as a function a distance along a length of the recessed portion 179 of the bolt carrier 121—e.g., a twisted spline comprising laterally spaced-apart surfaces with a recessed surface extending therebetween. As best shown in FIGS. 6-9 and 13, the bolt carrier includes belt mechanism motion control surfaces (i.e., the upper movement control surface 178 and the lower movement control surface 177).

In response to the engagement of the lower movement control surface 174 and the upper movement control surface 175 with the mating movement control surfaces 177, 178 of the bolt carrier 121, movement of the bolt carrier 121 between the battery-enabling position BRP and the rearward position results the pawl lever 172 pivoting about the lever pivot axis PA2 as a function of axial translation of the bolt carrier 121. Such synchronous movement of the bolt carrier 121 and the pawl lever 172 facilitate proper (i.e., synchronous loading of a new round of ammunition in concert with ejection of a spent casing from the bolt carrier group 113. The lower movement control surface 177, the upper movement control surface 178, and the recessed portion 179 of the bolt carrier 121 are provided in mirror-image fashion on the opposite side of the bolt carrier 121 for enabling the left-side and right-side belt feed capability disclosed herein.

Certain aspects of such structural components and operation of the belt feed mechanism 112 will become apparent to a skilled person in view of the disclosures made herein. Accordingly, the description provided herein is intended to be one of many potential approaches for facilitating ammunition belt feeding in a firearm in accordance with all or some other aspects of the disclosures made herein—e.g., caliber convertible, feed-side configurable, ambidextrous operability, lightweight design, modular design, user-configurability, and the like.

Figure 20:
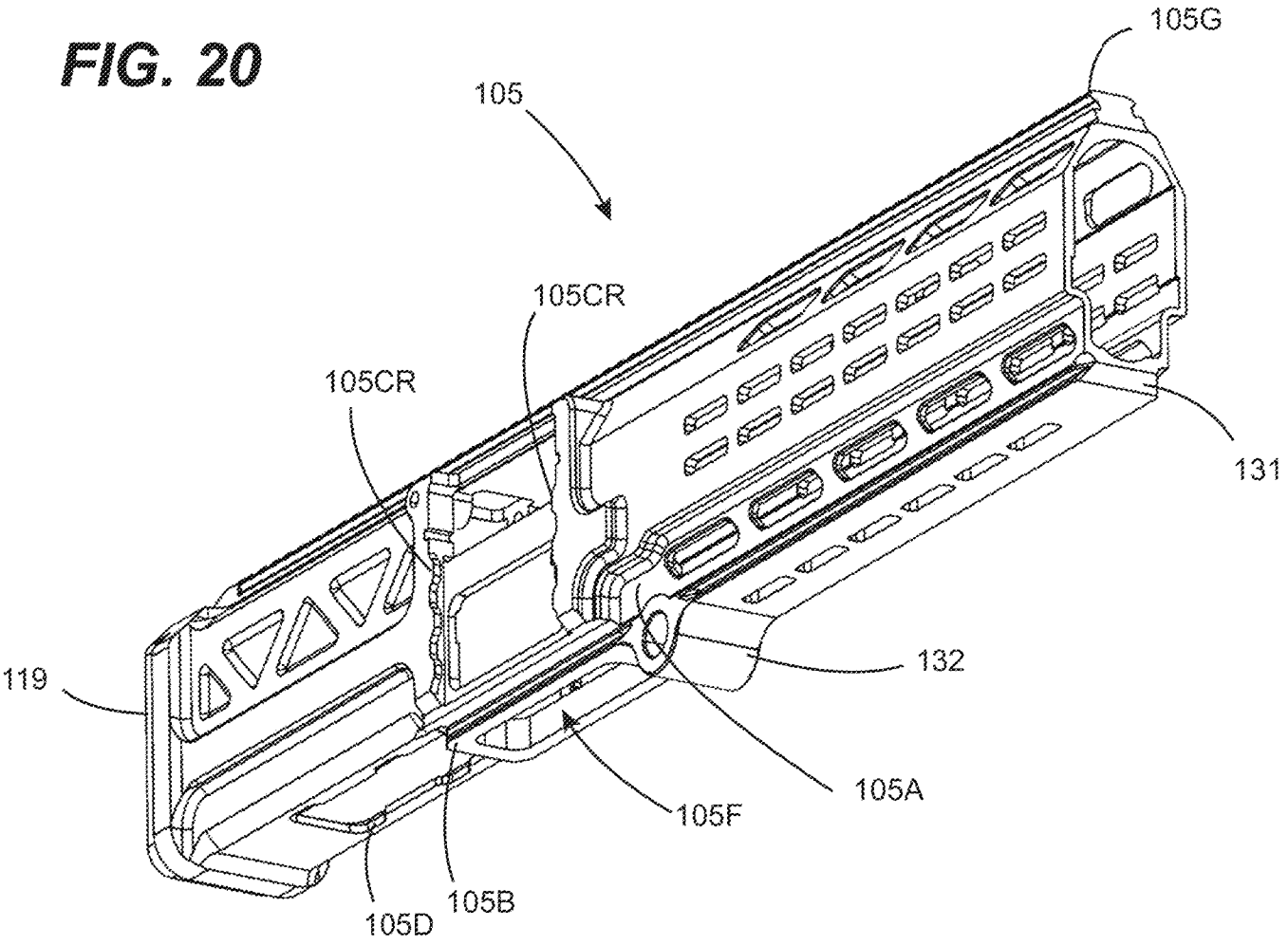
FIG. 20 is a first right-side perspective view of a main body of the firearm shown in FIGS. 1-4.
Figure 21:
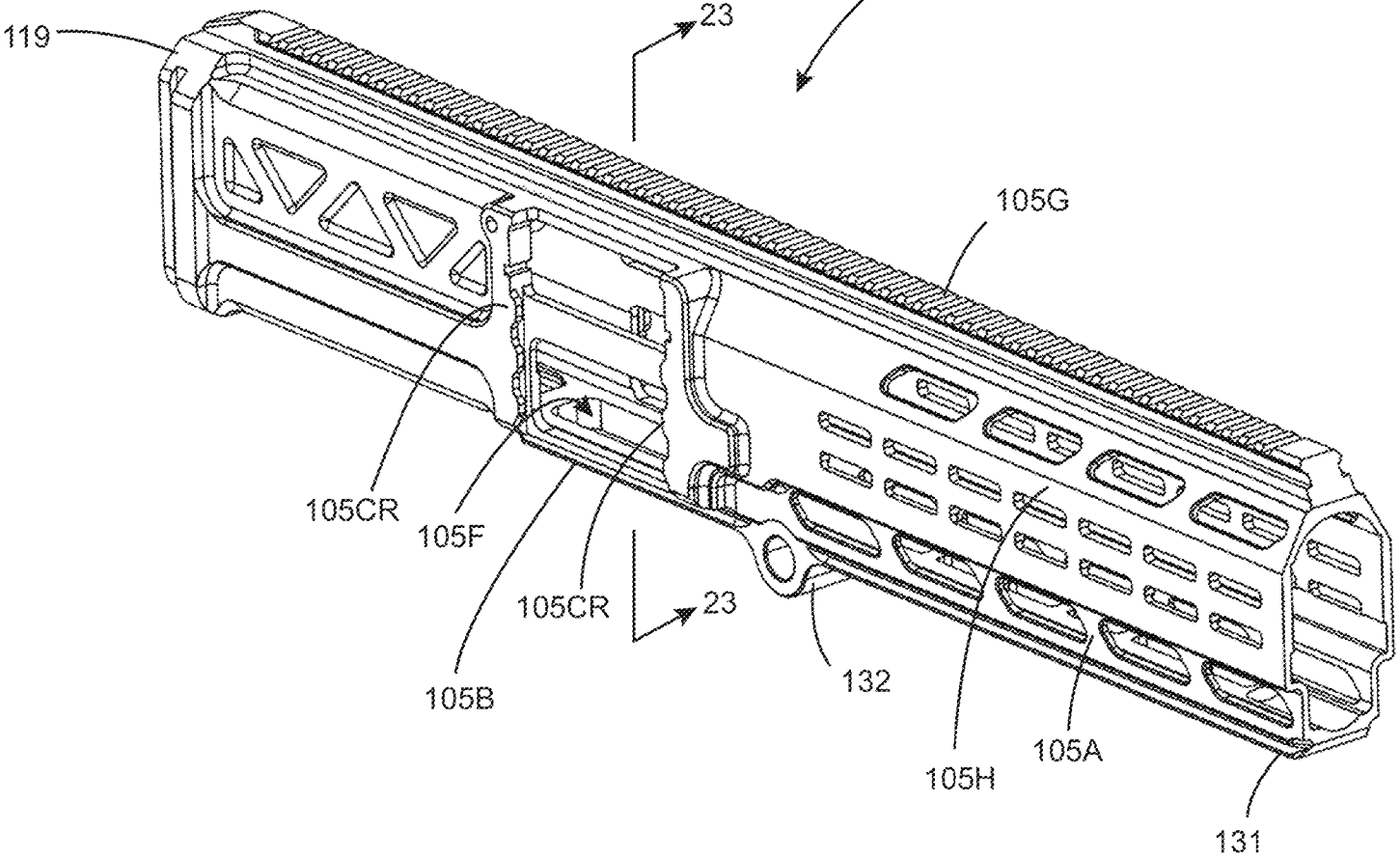
FIG. 21 is a second right-side perspective view of the main body shown in FIG. 20.
Figure 22:
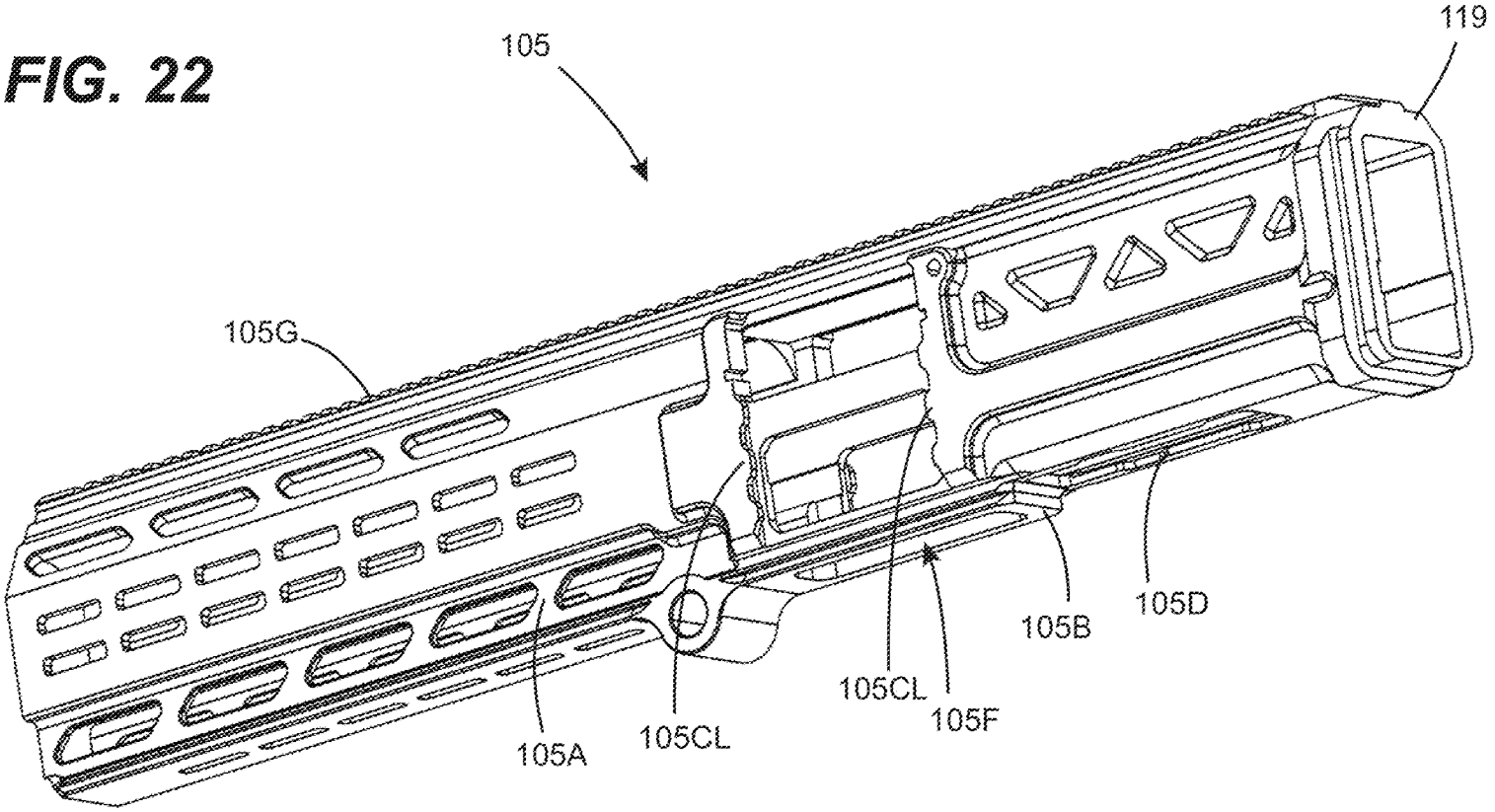
FIG. 22 is a left-side perspective view of the main body shown in FIG. 20.
Figure 23:
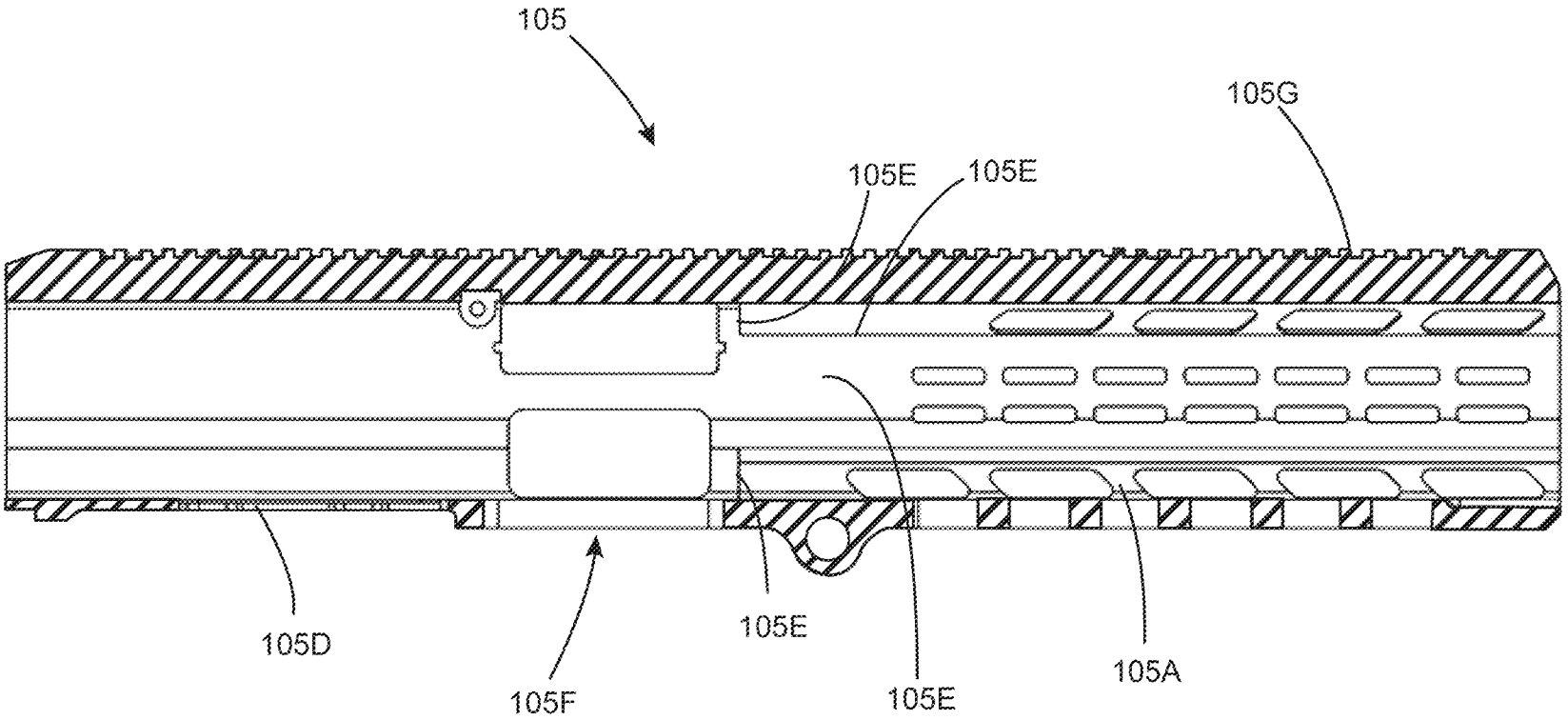
FIG. 23 is a cross-sectional view taken along the line 23-23 in FIG. 21.

As shown in FIGS. 20, 22, and 23, a trigger group mounting portion 105D of the main body 105 is provided for enabling fixed engagement of the trigger group 110 to the main body 105. For example, the trigger group mounting portion 105D may include a window with engagement discontinuities (e.g., protruding flanges) for enabling engagement by one or more mating protruding ribs or flanges 111A (FIGS. 6-9) of a main body 111 of the trigger group 110. The trigger group mounting portion 105D may be integral with a bottom wall of the main body 105. Alternatively, the trigger group 110 may be fixedly attached to the main body 105 via other fastening means such as transverse mounting pins.

As shown in FIGS. 1-4 and 20-23, the main body 105 may include a unitarily-formed handguard 105H (denoted in FIG. 21) and a top rail 105G that extends continuously along all or a portion of the main body 105 for mounting a variety of optic devices such as, for example, colored dot and holographic sights, high-magnification rifle scopes, image intensifiers (night vision devices), thermal imagers, and lasers. For example, the handguard 105H and the top rail 105G may extend in a continuous manner between opposing ends of the main body 105—e.g., fully between such opposing ends. The top rail 105G being continuous beneficially allows for optic devices to be mounted in-line together in the most comfortable positions for the shooter. Moreover, the top rail 105G is preferably a rigid component of the main body 105 (e.g., unitarily formed therewith) whereby there is no introduced loss of zero from the lack of a hard connection between the top rail 105G and the barrel 125. The top rail 105H may be unitarily-formed with the main body 105, may be an attached separately-formed component, or may be a combination thereof.

Advantageously, the firearm 100 is configured for enabling a user to perform a caliber conversion from one type of ammunition (e.g., caliber) to one or more other type of ammunition. For example, in some embodiments, conversion is facilitated via a caliber compatibility kit that may include a caliber-specific barrel assembly (at least the barrel and the barrel extension), a caliber-specific belt feed mechanism, and a caliber-specific bolt assembly, and a caliber-specific bolt carrier. In some embodiments, some but less all of the above components may be required for facilitating caliber conversion—e.g., omitting the need for a caliber-specific bolt assembly and/or a caliber-specific bolt carrier. One example of a caliber conversion of firearms configured in accordance with embodiments of the disclosures made herein is between 0.338 Norma Magnum and 7.62×51 mm NATO ammunition. Another example of a caliber conversion of firearms configured in accordance with embodiments of the disclosures made herein is between 0.556×45 mm NATO ammunition 7.62×51 mm NATO ammunition.

As discussed herein, firearms configured in accordance with embodiments of the disclosures made herein (e.g., the firearm 100) may be configurable between left-hand or right-hand feed. In this regard, ammunition feeding may be reversed so that an ammunition belt enters the right side, and empty links are ejected out of the left side of the firearm or vice-versa. Spent cartridge cases eject downward from the firearm, with an optional deflector that sends them either right or left depending on the mounted orientation of the deflector—e.g., opposite the chosen direction of feed. This feature provides for fully ambidextrous operation of the firearm and facilitates mounting of the firearm for example on either the right or left side of a vehicle, while still having convenient access to the feed mechanism. It also facilitates mounting the firearm in tight spaces where there may not be room on one side for ammunition to feed, such as in an armored vehicle or in an aircraft. In these applications, having the belt feed optionally in either direction opens far more options for positioning both the firearm and its feeding box. Additionally, the firearm can be configured in pairs with one firearm feeding from the right and one feeding from the left, and mounted side by side in twin, or quad mounts. This can give fast boats, light vehicles, and installations not only much greater range and punch, but substantial combined rate of fire, as well.

Figure 24:
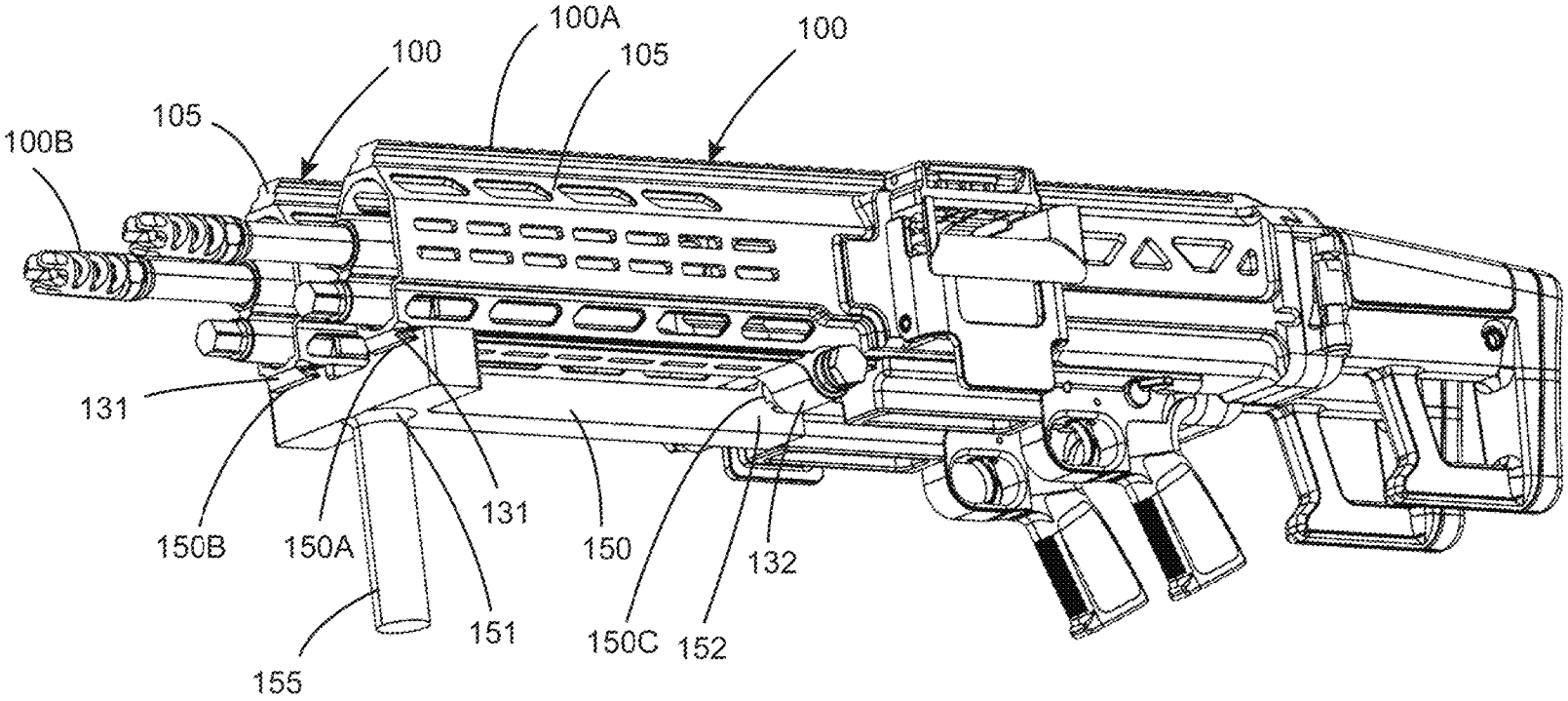
FIG. 24 is a first perspective view showing a side-by-side mounted arrangement of the firearm of FIGS. 1-4, with a first instance of the firearm having a left-side belt feeding arrangement as shown in FIGS. 1-2 in a left-side mounted position and a second instance of the firearm having a right-side belt feeding arrangement as shown in FIGS. 3-4 in a right-side mounted position.

FIG. 24 shows a pair of the firearm 100 discussed above mounted in a side-by-side arrangement. A first firearm 100 (i.e., first firearm 100A) is configured in a left-side belt feeding arrangement and a second firearm 100 (i.e., second firearm 100B) is configured in a right-side belt feeding arrangement. A mounting bracket 150 includes spaced apart forward mounting portions 150A, 150B at its front end portion 151 that engages a first mounting portion 131 of a respective one of the firearms 100A, 100B and a rear mounting portion 150C at its rear end portion 152 that engages a second mounting portion 132 of the respective one of the firearms 100A, 100B. The forward mounting portions 150A, 150B may be dovetail grooves that engage a mating profiled mounting member 131 (e.g., profiled elongated rail) of the main body 105 of the respective one of the firearms 100A, 100B, or through alternate mounting means. The rear mounting portion 150C may be a mounting member that is engaged with a mating mounting member 132 (e.g., mounting boss) of the main body 105 of the respective one of the firearms 100A, 100B. The mounting bracket 150 includes an engagement member 155 for enabling the mounting bracket 150 to be mounted on a mating mounting structure such as for example a land vehicle mount, a marine vehicle mount, an aircraft mount, or the like.

Figure 25:
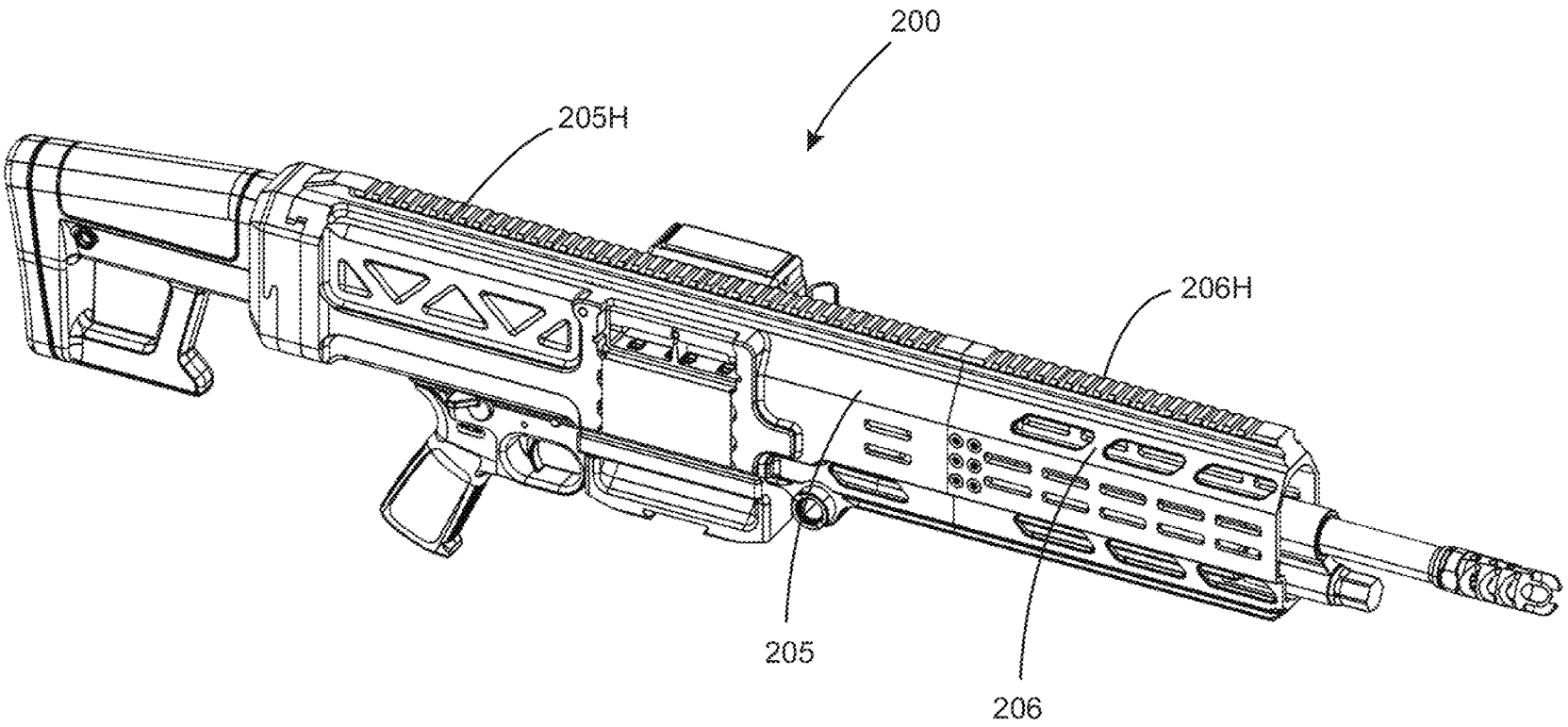
FIG. 25 is a perspective view of a firearm in accordance with one or more embodiment of the present invention, having a main body and a handguard that are separate structural components from each other.

FIG. 25 shows a firearm in accordance with one or more embodiment of the present invention (i.e., firearm 200) that includes a main body 205 and a handguard 206 that are separate structural components from each other. As a skilled person will appreciate in view of the disclosures made herein, the handguard 206 may be attached directly to the main body 205 and/or to another component of the firearm 200. As shown, the main body 205 may include a top rail 205H and the handguard 206 may include a top rail 206H that may each be respectively unitarily-formed therewith, may each be respectively an attached separately-formed component, or may be a combination thereof.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in all its aspects. Although the invention has been described with reference to particular means, materials and embodiments, the invention is not intended to be limited to the particulars disclosed; rather, the invention extends to all functionally equivalent technologies, structures, methods and uses such as are within the scope of the appended claims.

What is claimed is:

1. A firearm, comprising:

a main body having opposing belt feed assembly mounting structures; and a belt feed assembly selectively engageable with either one of the belt feed assembly mounting structures for enabling belt-fed ammunition to be supplied from the belt feed assembly when engaged with either one of the belt feed assembly mounting structures.

2. The firearm of claim 1, wherein:

a first one of the belt feed assembly mounting structures is located on a left side of the main body; and a second one of the belt feed assembly mounting structures is located on a right side of the main body.

3. The firearm of claim 1, wherein the belt feed assembly has a symmetric construction relative to a plane that vertically bisects the belt feed assembly and that extends parallel to an ammunition feed direction of the belt feed assembly.

4. The firearm of claim 3, wherein:

a first one of the belt feed assembly mounting structures is located on a left side of the main body; and a second one of the belt feed assembly mounting structures is located on a right side of the main body.

5. The firearm of claim 4, further comprising:

a belt box mount engaged with the main body at a fixed position of the main body, wherein the belt box mount being engaged with the main body at the fixed position enables the belt box mount to secure the belt feed assembly in engagement with both of the belt feed assembly mounting structures.

6. The firearm of claim 1, further comprising:

a belt box mount engaged with the main body at a fixed position of the main body, wherein the belt box mount being engaged with the main body at the fixed position secures the belt feed assembly in engagement with either of the belt feed assembly mounting structures.

7. The firearm of claim 1, further comprising:

a bolt carrier slidably engaged with the main body between the opposing belt feed assembly mounting structures, wherein the bolt carrier includes belt mechanism motion control surfaces on opposing sides thereof.

8. The firearm of claim 1, further comprising:

a barrel attached to the main body; and a bolt carrier group operably attached to the main body between the opposing belt feed assembly mounting structures;

wherein the belt feed assembly and the bolt carrier group are jointly operable to supply ammunition to a chamber of the barrel when the belt feed assembly is engaged with either one of the belt feed assembly mounting structures.

9. The firearm of claim 8, wherein the bolt carrier group is engaged with the main body at a fixed position relative to the position of the belt feed assembly.

10. The firearm of claim 8, wherein the belt feed assembly has a symmetric construction relative to a plane that vertically bisects the belt feed assembly and that extends parallel to an ammunition feed direction of the belt feed assembly.

11. The firearm of claim 8, wherein:

a bolt carrier of the bolt carrier group is slidably engaged with the main body between the opposing belt feed assembly mounting structures; and the bolt carrier includes belt mechanism motion control surfaces on opposing sides thereof.

12. The firearm of claim 11, wherein the bolt carrier group is engaged with the main body at a fixed position relative to the position of the belt feed assembly.

13. The firearm of claim 12, wherein the belt feed assembly has a symmetric construction relative to a plane that vertically bisects the belt feed assembly and that extends parallel to an ammunition feed direction of the belt feed assembly.

14. The firearm of claim 13, further comprising:

a belt box mount engaged with the main body at a fixed position of the main body, wherein the belt box mount being engaged with the main body at the fixed position enables the belt box mount to secure the belt feed assembly in engagement with both of the belt feed assembly mounting structures.

15. The firearm of claim 11, wherein the belt feed assembly has a symmetric construction relative to a plane that vertically bisects the belt feed assembly and that extends parallel to an ammunition feed direction of the belt feed assembly.

16. The firearm of claim 8, further comprising:

a belt box mount engaged with the main body at a fixed position of the main body, wherein the belt box mount being engaged with the main body at the fixed position enables the belt box mount to secure the belt feed assembly in engagement with both of the belt feed assembly mounting structures.

17. The firearm of claim 1, further comprising:

a bolt carrier slidably engaged with the main body between the opposing belt feed assembly mounting structures;

wherein the bolt carrier includes a first set of belt mechanism motion control surfaces on a first side of the bolt carrier and a second set of belt mechanism motion control surfaces on a second side of the bolt carrier opposite the first side thereof;

wherein movement control surfaces of a feed lever of the belt feed assembly engage the first set of belt mechanism motion control surfaces when the bolt feed mechanism is engaged with a first one of the belt feed assembly mounting structures; and wherein the movement control surfaces of the feed lever engage the second set of belt mechanism motion control surfaces when the belt feed mechanism is engaged with a second one of the belt feed assembly mounting structures.

18. The firearm of claim 17, wherein the belt feed assembly has a symmetric construction relative to a plane that vertically bisects the belt feed assembly and that extends parallel to an ammunition feed direction of the belt feed assembly.

19. The firearm of claim 17, further comprising:

a belt box mount engaged with the main body at a fixed position of the main body, wherein the belt box mount being engaged with the main body at the fixed position secures the belt feed assembly in engaged with either of the belt feed assembly mounting structures.

20. The firearm of claim 19, wherein the belt feed assembly has a symmetric construction relative to a plane that vertically bisects the belt feed assembly and that extends parallel to an ammunition feed direction of the belt feed assembly.

* * * * *